US011382467B2

(12) United States Patent
Poirier et al.

(10) Patent No.: US 11,382,467 B2
(45) Date of Patent: Jul. 12, 2022

(54) SPINDLE ASSEMBLY FOR A WEB MATERIAL DISPENSER, WEB MATERIAL ROLL DISPENSING ASSEMBLY AND METHOD FOR INSERTING A WEB MATERIAL ROLL IN A DISPENSER

(71) Applicant: CASCADES CANADA ULC, Québec (CA)

(72) Inventors: Gabrielle Poirier, Longueuil (CA); Manuel Léveillé, Montreal (CA); Benoit Orban, Saint-Lambert, CA (US)

(73) Assignee: CASCADES CANADA ULC, Kingsey Falls (CA)

( * ) Notice: Subject to any disclaimer, the term of this patent is extended or adjusted under 35 U.S.C. 154(b) by 346 days.

(21) Appl. No.: 16/681,528

(22) Filed: Nov. 12, 2019

(65) Prior Publication Data

US 2020/0146517 A1 May 14, 2020

Related U.S. Application Data

(60) Provisional application No. 62/767,082, filed on Nov. 14, 2018.

(51) Int. Cl.
*A47K 10/36* (2006.01)

(52) U.S. Cl.
CPC .. *A47K 10/3687* (2013.01); *A47K 2010/3681* (2013.01)

(58) Field of Classification Search
None
See application file for complete search history.

(56) References Cited

U.S. PATENT DOCUMENTS

| | | | | | |
|---|---|---|---|---|---|
| 3,764,083 | A * | 10/1973 | Gretener | B65H 75/30 | 242/118.3 |
| 5,370,336 | A * | 12/1994 | Whittington | A47K 10/3836 | 242/560.2 |
| 5,577,686 | A * | 11/1996 | Moody | A47K 10/3836 | 242/597.4 |
| 5,669,576 | A | 9/1997 | Moody | | |
| 5,947,409 | A * | 9/1999 | Corrigan, Jr. | F16D 41/206 | 242/571.4 |
| 10,765,273 | B1 * | 9/2020 | Work | B65H 75/08 | |
| 2010/0187351 | A1 * | 7/2010 | Billman | A47K 10/40 | 242/599 |
| 2017/0071421 | A1 | 3/2017 | Hagleitner | | |
| 2020/0008630 | A1 * | 1/2020 | Robertson | B65H 19/10 | |
| 2020/0102180 | A1 * | 4/2020 | Robertson | B65H 75/241 | |

* cited by examiner

*Primary Examiner* — William A. Rivera
(74) *Attorney, Agent, or Firm* — Marshall, Gerstein & Borun LLP

(57) ABSTRACT

A spindle assembly for supporting a web material roll in a web material dispenser, the web material roll having first and second extremities and defining a central cavity provided with a bushing toward the first extremity. The spindle assembly includes a bushing-engaging member having: a first dispenser mounting portion mountable to a first side of the dispenser, and a bushing-engaging portion sized and configured to fit at least partially in the bushing; and a spindle connection member having: a second dispenser mounting portion mountable to a second side of the dispenser, and a connecting portion removably mountable to the bushing-engaging member; thereby allowing use of the roll with the bushing in the dispenser. Also, a roll dispensing assembly and a method for inserting a roll of web material in a dispenser.

29 Claims, 19 Drawing Sheets

SPINDLE ASSEMBLY FOR A WEB MATERIAL DISPENSER, WEB MATERIAL ROLL DISPENSING ASSEMBLY AND METHOD FOR INSERTING A WEB MATERIAL ROLL IN A DISPENSER

PRIOR APPLICATION

The present application claims the benefit of the filing date of U.S. provisional patent application No. 62/767,082, filed on Nov. 14, 2018, and entitled "SPINDLE ASSEMBLY FOR A DISPENSER OF ROLLED WEB MATERIAL AND ROLLED WEB MATERIAL DISPENSING ASSEMBLY", the disclosure of which being hereby incorporated by reference in its entirety.

TECHNICAL FIELD

The present disclosure generally relates to rolls of web material and to dispensers of rolled web material. More particularly, the disclosure relates to a spindle assembly to support a roll of web material in a dispenser; to a rolled web material dispensing assembly and to a method for inserting a roll of web material in a dispenser of rolled web material.

BACKGROUND

Several types of paper roll dispensers exist in the prior art that are used to gradually provide a user of the paper roll dispenser with different types of paper. The most common of these types of paper roll dispensers, dispenses paper items such as paper towels or toilet paper. Some of these paper rolls include a bushing provided in a cavity thereof, to interact with the mandrel of the dispenser. The bushing provided in the cavity of the roll can facilitate and improve roll replacement in the dispensers. However, the bushing might make the paper roll unusable in certain types of paper roll dispensers.

It could be advantageous to allow the use of paper rolls which include a bushing, in paper roll dispensers that are not originally configured to be used with such paper rolls.

BRIEF SUMMARY

The present invention aims to address at least some of the above-mentioned needs and provide a spindle assembly for supporting a roll of web material in a dispenser, a roll dispensing assembly and a method for supporting a roll of web material in a dispenser.

According to a general aspect, there is provided a spindle assembly for supporting a web material roll in a web material dispenser having first and second opposed sides, the web material roll having first and second extremities and defining a central cavity provided with a bushing toward the first extremity. The spindle assembly comprises a bushing-engaging member comprises a first dispenser mounting portion mountable to the first side of the web material dispenser, and a bushing-engaging portion sized and configured to fit at least partially in the bushing; and a spindle connection member comprising: a second dispenser mounting portion mountable to the second side of the web material dispenser, and a connecting portion mountable to at least one of the second extremity of the web material roll and the bushing-engaging member; thereby allowing use of the web material roll with the bushing in the web material dispenser.

According to another general aspect, there is provided a spindle assembly for supporting a web material roll in a web material dispenser having first and second opposed sides, the web material roll having first and second extremities and defining a central cavity provided with a bushing toward the first extremity, the spindle assembly comprising: a bushing-engaging member comprising: a first dispenser mounting portion removably mountable to the first side of the web material dispenser, and a bushing-engaging portion extending from the first dispenser mounting portion and being at least partially engageable in the bushing of the web material roll; and a spindle connection member comprising: a second dispenser mounting portion removably mountable to the second side of the web material dispenser; and a connection portion at least partially engageable into the cavity of the web material roll toward the second extremity and connectable to the bushing-engaging portion to configure the spindle connection member and the bushing-engaging member in an assembled configuration thereby allowing use of the web material roll with the bushing in the web material dispenser.

According to another general aspect, there is provided a roll dispensing assembly comprising a web material roll having first and second extremities and defining a central cavity provided with a bushing toward the first extremity; and a spindle assembly according to the present disclosure, the bushing-engaging member and the spindle connection member being mountable respectively to the first and second extremities of the web material roll.

According to another general aspect, there is provided a method for inserting a web material roll in a web material dispenser, the web material dispenser having first and second sides, the web material roll having first and second extremities and defining a central cavity provided with a bushing toward the first extremity, the method comprising: providing a spindle assembly comprising: a bushing-engaging member comprising a first dispenser mounting portion and a bushing-engaging portion; and a spindle connection member comprising a second dispenser mounting portion and a connecting portion; engaging the bushing-engaging portion in the bushing of the web material roll; and introducing the spindle connection member in the central cavity via the second extremity.

According to another general aspect, there is provided a spindle assembly for supporting a roll of web material in a dispenser; the dispenser has first and second sides, and the roll of web material has first and second extremities and a central cavity provided with a bushing, toward the first extremity. The spindle assembly comprises a first spindle element having a first dispenser mounting portion and a bushing mounting portion. The first dispenser mounting portion is removably mountable to the first side of the dispenser, and the bushing mounting portion is sized and configured to fit in the bushing. The spindle assembly further comprises a second spindle element having a second dispenser mounting portion removably mountable to the second side of the dispenser, and a connecting portion mountable to the second extremity of the roll and/or to the first spindle element, thereby allowing use of the roll of web material with the bushing in the dispenser.

According to another general aspect, there is provided a spindle assembly for supporting a roll of web material in a dispenser having first and second sides; the roll of web material has first and second extremities and a central cavity provided with a bushing, toward the first extremity. The spindle assembly comprises a first spindle element comprising a first dispenser mounting portion removably mountable to the first side of the dispenser, and a bushing mounting portion extending from the first dispenser mounting portion and being engageable in the bushing of the web material roll.

The spindle assembly further comprises a second spindle element at least partially engageable in the cavity of the roll toward the second extremity and comprising a second dispenser mounting portion removably mountable to the second side of the dispenser. One of the first and second spindle elements comprises an assembling rod and the other one of the first and second spindle elements comprises an assembling sleeve defining an assembling cavity to receive the assembling rod for the first and second spindle elements to be assembled together thereby allowing use of the roll of web material with a bushing in the dispenser.

According to another general aspect, there is provided a roll dispensing assembly comprising a roll of web material having first and second extremities and a central cavity provided with a bushing, toward the first extremity, and a spindle assembly according to the present disclosure. The first and second spindle elements are mountable respectively to the first and second extremities.

According to another general aspect, there is provided a method for inserting a roll of web material in a dispenser, the dispenser having first and second sides, the roll of web material having first and second extremities and a central cavity provided with a bushing, toward the first extremity. The method comprises providing a spindle assembly according to the present disclosure, engaging the first spindle element in the bushing of the roll of web material, introducing the second spindle element in the central cavity via the second extremity and mounting the first and second dispenser mounting portions respectively to the first and second sides of the dispenser.

DETAILED DESCRIPTION

Figure 1:
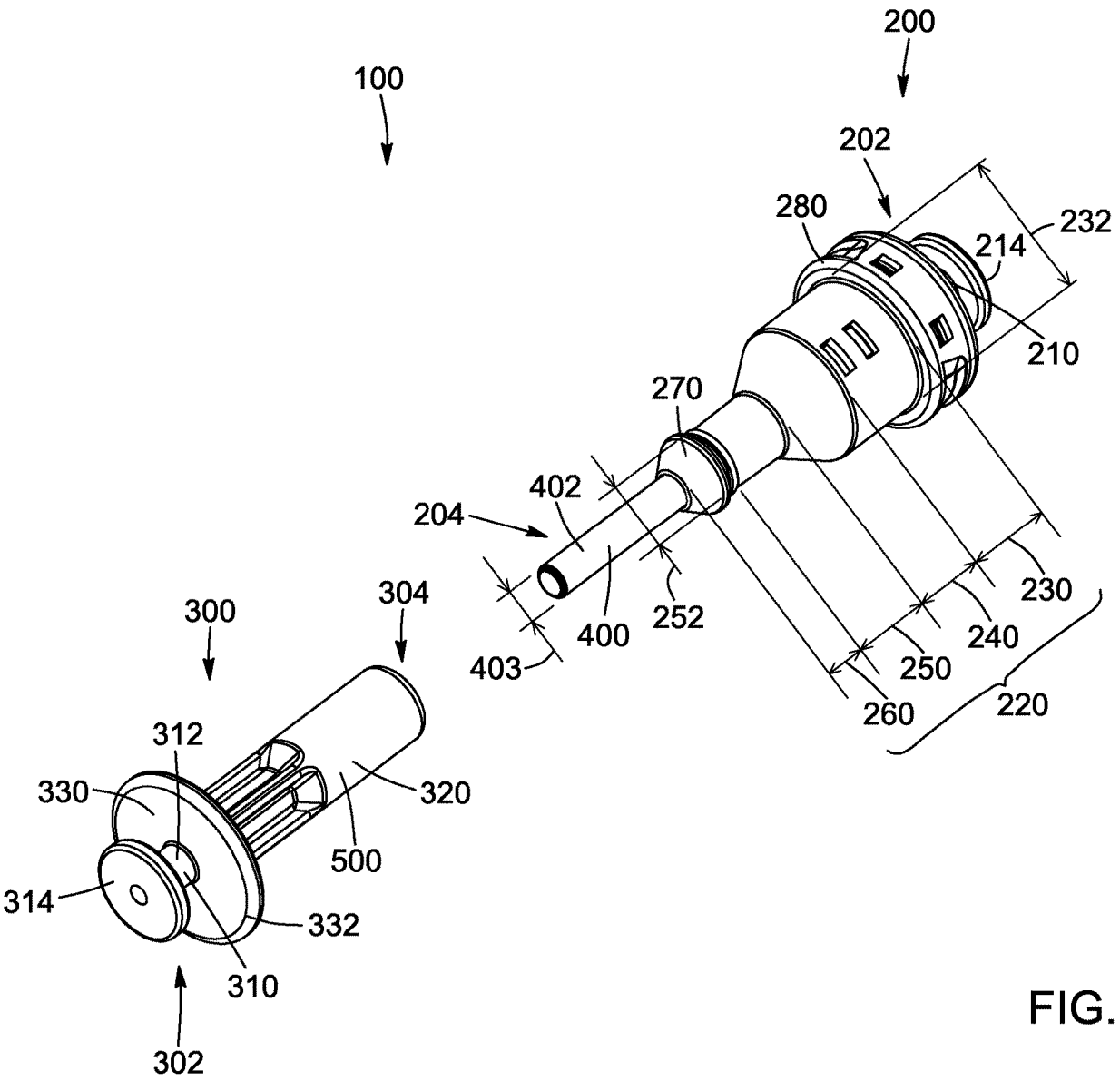
FIGS. 1 and 2 are right and left perspective views of a spindle assembly in accordance with an embodiment, the spindle assembly shown with first and second spindle elements being configured in a disassembled configuration.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Moreover, it will be appreciated that positional descriptions such as "above", "below", "forward", "rearward" "left", "right" and the like should, unless otherwise indicated, be taken in the context of the figures and correspond to the position and orientation of the web material roll and corresponding parts when being mounted to a web material roll dispenser. The terms "inner", "interior" and "outer" should be understood as being relative to the central cavity of the web material roll. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, the term "about" means within an acceptable error range for the particular value as determined by one of ordinary skill in the art, which will depend in part on how the value is measured or determined, i.e. the limitations of the measurement system. It is commonly accepted that a 10% precision measure is acceptable and encompasses the term "about".

In the present description, an embodiment is an example or implementation of the invention. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and is for descriptive purposes only. The principles and uses of the teachings of the present invention may be better understood with reference to the accompanying description, figures and examples. It is to be understood that the details set forth herein do not construe a limitation to an application of the invention. Furthermore, it is to be understood that the invention can be carried out or practiced in various ways and that the invention can be implemented in embodiments other than the ones outlined in the description above.

It is to be understood that the terms "including", "comprising", and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element. It is to be understood that where the claims or specification refer to "a" or "an" element, such reference is not to be construed as limited to only one of that element. It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks. The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined. The present invention may be implemented in the testing or practice with methods and materials equivalent or similar to those described herein.

Figure 20:
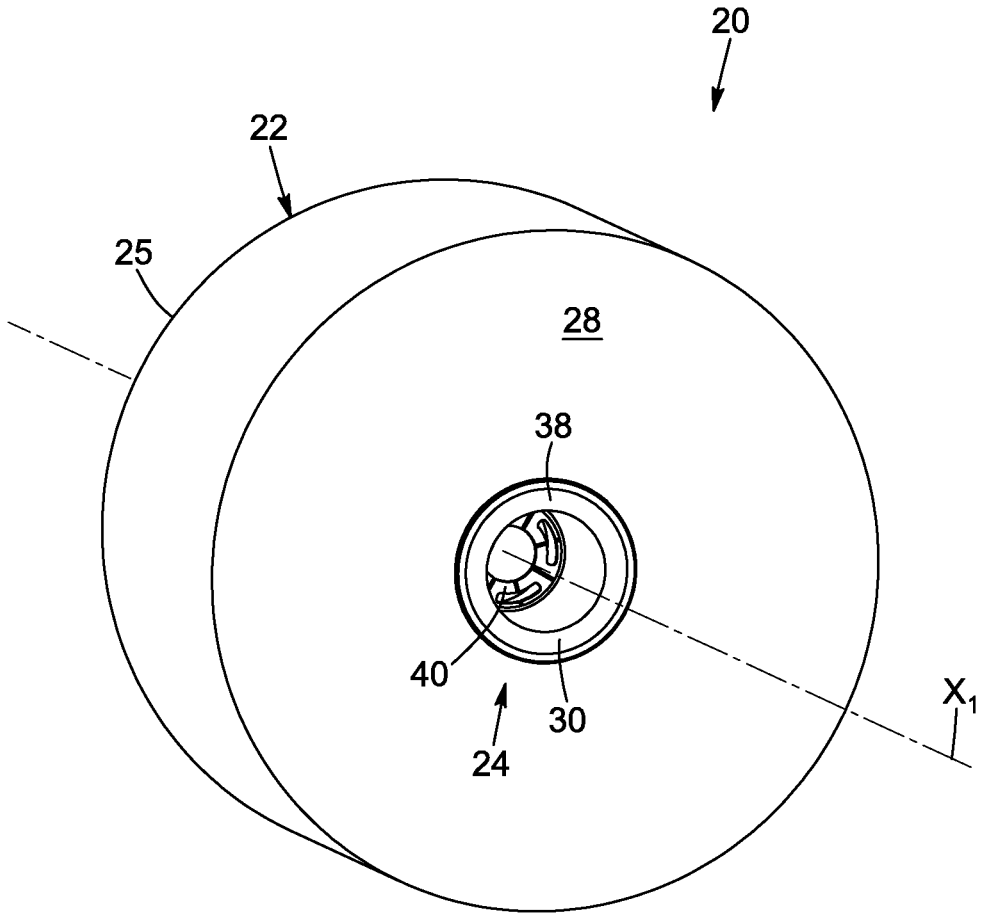
FIG. 20 is a side perspective view of the roll of web material of FIG. 8, with no spindle assembly inserted therein.

Referring to the drawings, and more particularly to FIGS. 1 to 12, a first embodiment of a spindle assembly 100 is shown, for supporting a roll 20 of web material 21—or web material roll 20 (as represented in FIG. 20)—in a dispenser 10 (or web material dispenser). The web material roll 20 defines a central cavity 26 of the roll 20. Moreover, the web material roll 20 has a bushing 30 provided in its central cavity 26. As it will be further detailed, the spindle assembly 100 comprises first and second spindle elements 200, 300 (or a bushing-engaging member 200 and a spindle connection member 300, or first and second roll support members 200, 300) configured to be assembled together (i.e. to be configured in an assembled configuration) thereby allowing use of the web material roll 20 with the bushing 30 in the web material dispenser 10. The term "use" should be understood as referring to the delivery or dispensing of the web material 21 via a dispenser opening (not represented) of the web material dispenser 10. The spindle assembly 100 may also be referred to as a "spindle adaptor", since it allows replacing the conventional spindle (or mandrel) of dispensers for instance configured to receive web material rolls without a bushing provided in their cavity, with the "spindle assembly" or "spindle adaptor", so as to allow receiving rolls provided with a bushing inserted therein.

Web Material Dispenser and Web Material Roll

Referring to the drawings, and more particularly to FIGS. 12, 19 and 21 to 23, the dispenser 10 (or web material dispenser 10) is configured to dispense rolled web material 21. The dispenser 10 comprises a first (or left) side 12 and a space-apart second side 16 (or right side), the first and second sides 12, 16 defining at least partially a dispenser cavity 19 in between, to receive the roll 20 of web material 21. The roll of web material 21 can be a roll of hygienic paper for example.

In the embodiment shown, the first and second sides 12, 16 are substantially parallel to each other and extend, for instance, in substantially vertical planes. First and second guiding rails 14, 18 are formed respectively in the first and second sides 12, 16. The rails can take other shapes and configuration, as long they allow receiving opposite ends of the spindle assembly 100. For instance, and without being limitative, the dispenser 10 could comprise first and second substantially U-shaped receiving portions mounted respectively to the first and second sides 12, 16 dimensioned and shaped to receive the opposite ends of the spindle assembly 100. Elongated slots could also be formed in the first and second sides 12, 16 communicating with the dispenser cavity 19 and be shaped and dimensioned to receive the opposite ends of the spindle assembly 100.

Referring to FIGS. 8, 11, 12 and 20, the roll 20 of web material 21 illustrated is a toilet/hygienic paper roll and has a central axis X1. The roll 20 of web material has first and second opposed extremities 22, 24. The rolled web material 21 defines two opposed lateral sides 25, 28 that extend, in this embodiment, substantially parallel to each other in substantially vertical planes. In other words, in the embodiment shown, the opposed lateral sides 25, 28 extend substantially perpendicularly to the central axis X1.

In the illustrated embodiment, the roll 20 of web material further comprises a hollow central core 23 inserted in the central cavity 26 defined by the rolled web material 21, typically made of cardboard, around which the web material 21 is rolled. Even though the hollow central core 23 might be useful to help and maintain the shape and dimensions of the central cavity 26 of the web material roll 20, it could be conceived a web material roll 20 in which the central cavity 26 would only be defined by the rolled web material 21. Such rolls of web material are sometimes referred to as "coreless" rolls.

The roll 20 of web material can be a toilet paper roll, a hand towel paper roll, or any other type of rolled paper or more globally any other type of rolled web material product.

The web material roll 20 illustrated is a toilet/hygienic paper roll, comprising the bushing 30 inserted therein, provided in the roll's central cavity 26, toward the first extremity 22, as best shown in FIG. 20. In the embodiment shown, the central cavity 26 has a cross-section 27 (FIG. 8) substantially constant along the central axis X1. The central cavity 26 is shaped and dimensioned for the bushing 30 to be at least partially inserted therein. This embodiment of a bushing is only one of many possible other configurations of bushings that can be used according to the present invention. Different possible embodiments of the bushing 30 are described in CA 3.036.028 filed by the Applicant. In this example, a single bushing is inserted at one of the extremities 22, 24 of the roll 20 of web material, but in other embodiments, it is possible to have two bushings, one bushing being inserted in each of the two extremities of the roll of web material.

When inserted into the roll 20 of web material, the bushing 30 defines a central axis that substantially coincides with the central axis X1 of the roll 20. In other words, when the bushing 30 is inserted in the roll 20 of web material, the central axis of the bushing 30 is preferably substantially coaxial with the central axis X1 of the roll 20 of web material.

Referring to FIGS. 8 to 12, the bushing 30 comprises a body 32 sized, shaped and configured to be fitted at least partially into the central cavity 26 of the roll 20. The bushing 30 has first and second ends 34, 36. When the bushing 30 is fitted in the central cavity 26 of the roll 20, the first end 34 is proximate to the first extremity 22 of the roll 20.

It is thus understood that the bushing 30 is configured to be mounted in at least one of the extremities of the roll 20 by being snugly fitted into the central cavity 26 thereof, so that the bushing 30 cannot rotate relative to the roll 20 around the central axis X1 once in place.

Figure 8:
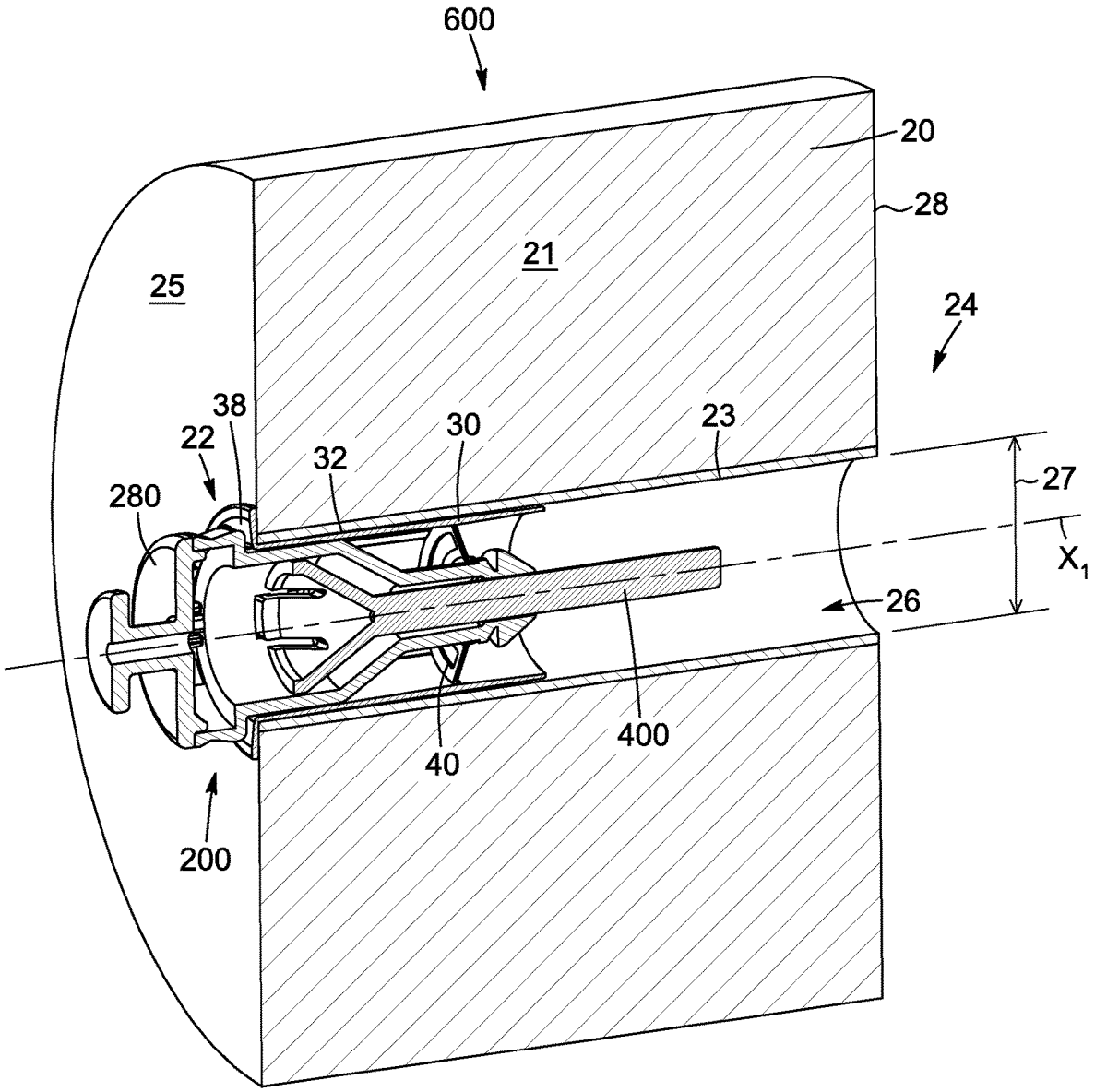
FIG. 8 is a cross-section view, in perspective, of a roll dispensing assembly comprising a roll of web material defining a central cavity provided with a bushing, the first spindle element of the spindle assembly of FIGS. 1 and 2 being inserted in the bushing.

The bushing 30 may further comprise an outside collar 38 extending from and encircling the first end 34. As illustrated in FIG. 8, when the bushing 30 is inserted into the roll 20 of web material, the outside collar 38 abuts the first lateral side 25 of the roll 20.

Figure 9:
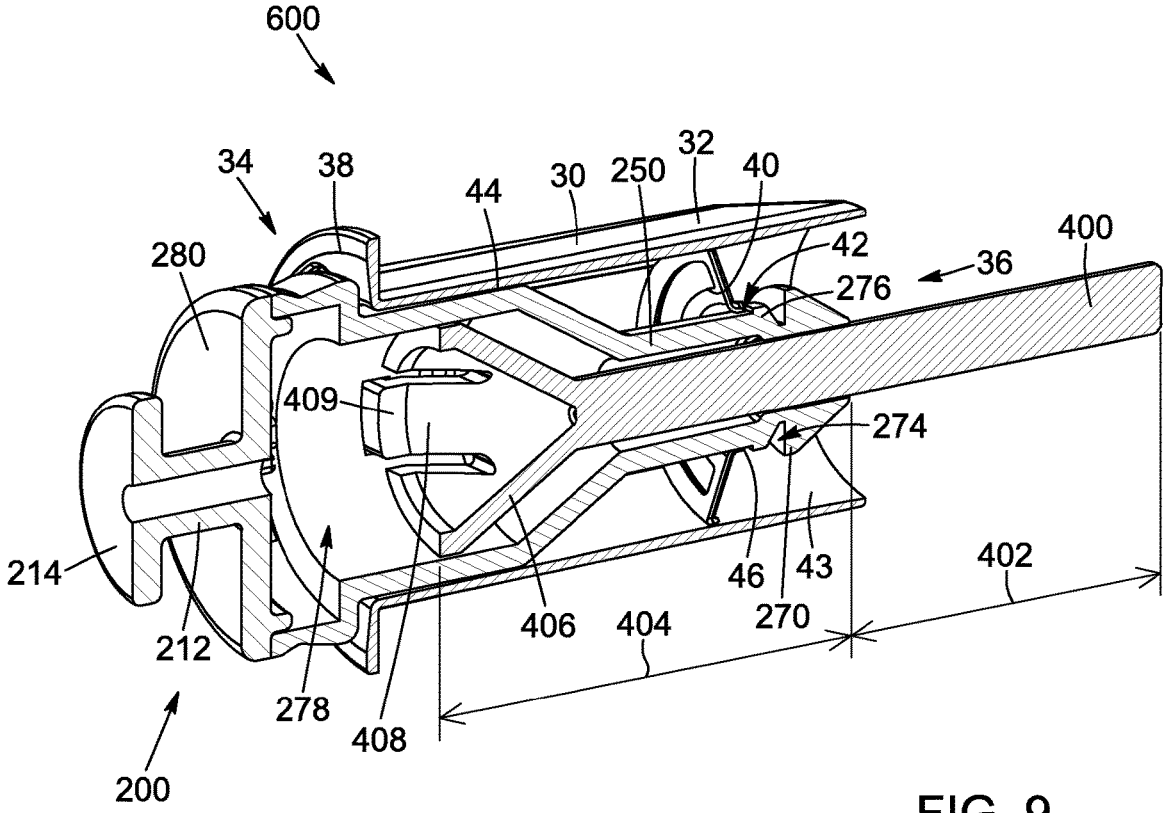
FIGS. 9 and 10 are enlarged cross-section views, in perspective, of the first spindle element and the bushing of the roll dispensing assembly of FIG. 8, without the roll of web material.
Figure 10:
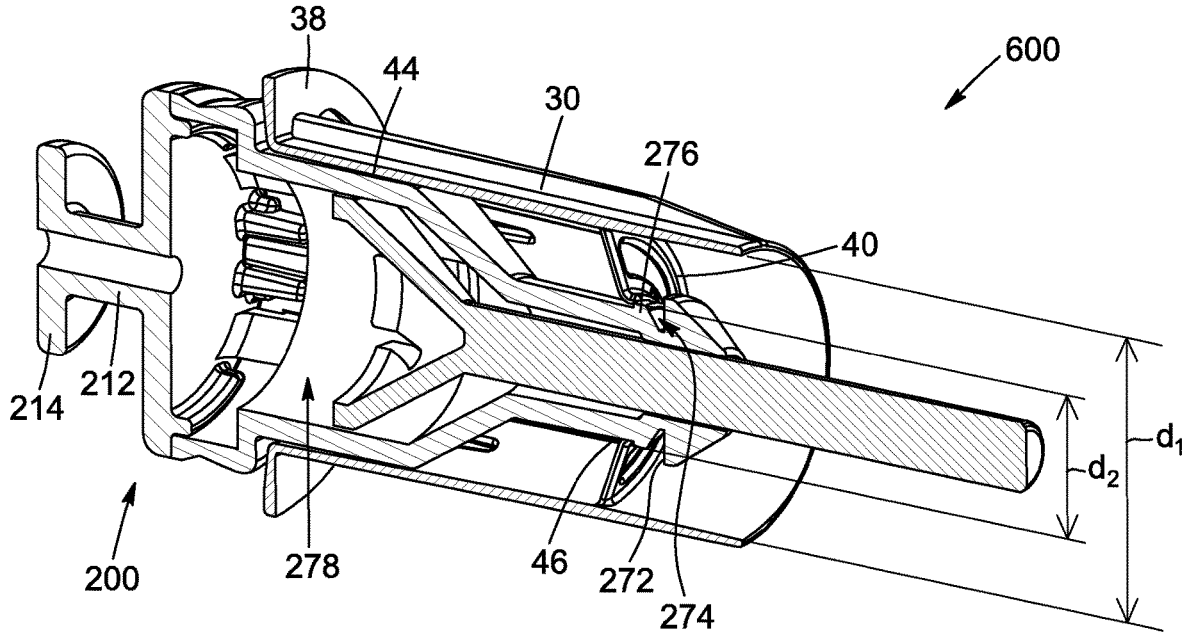
Figure 11:
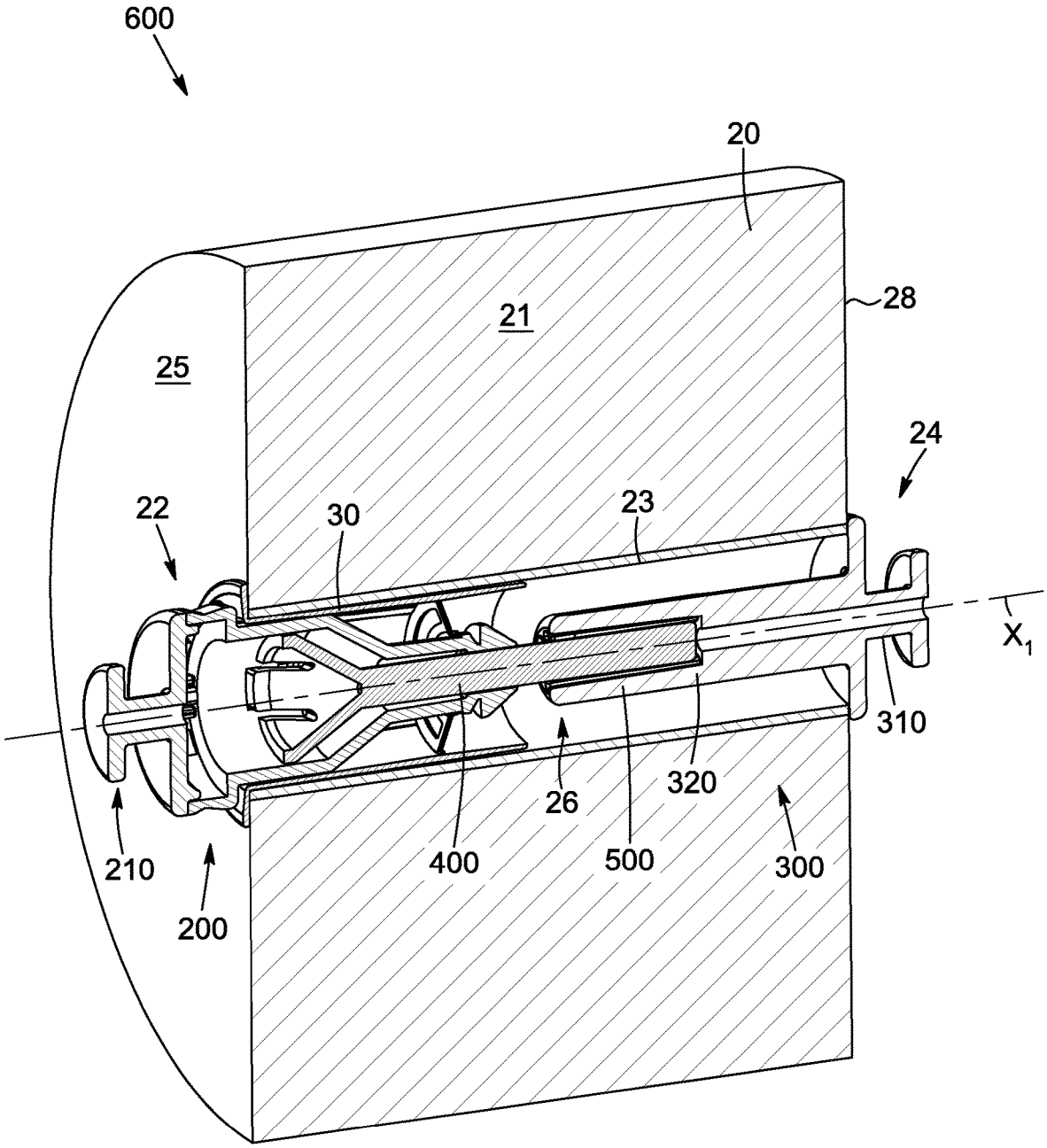
FIG. 11 is a cross-section view, in perspective of the roll dispensing assembly of FIG. 8, the first and second spindle elements of the spindle assembly of FIGS. 1 and 2 being engaged in the central cavity and connected to each other.

As best shown in FIGS. 9 and 10, the bushing 30 may further comprise a wall 40 that is configured to extend, when the bushing 30 is at least partially inserted into the central cavity 26 of the roll 20 of web material, across the central cavity 26 of the roll 20. The wall 40 includes an opening or hole 42. In the embodiment shown, the wall 40 of the bushing 30 is configured to be at least partially broken, as will be described below, when the first spindle element 200 is removed from the roll 20 of web material.

As best shown in FIGS. 9 and 10, the body 32 of the bushing 30 has an inner surface 43 having a portion located near the first end 34 of the bushing 30 and defining a first bearing surface or contact surface 44. This first bearing surface 44 has a first diameter d1 (identified in FIG. 10). The surface of the opening 42 formed in the wall 40 defines a second bearing surface or contact surface 46 having a second diameter d2, the second diameter d2 being smaller than the first diameter d1. In this embodiment, the bushing 30 is fixedly inserted in the roll. In the embodiment shown, the first spindle element 200 or bushing-engaging member 200 of the spindle adaptor/assembly 100 can be rotatable with respect to the bushing 30 (and with respect to the web material roll 20 provided with the bushing 30) about the central axis X1. For instance, the first and second bearing surfaces 44, 46 contact the bushing-engaging member 200 when the bushing-engaging member 200 and the bushing 30 are rotated relative to each other about the central axis X1. The first spindle element 200 of the spindle assembly 100 can thus be rotated about the first axis X1 with respect to the roll 20 provided with the bushing 30.

Depending for instance on the pulling force exerted on the web material 21 and/or on the material forming the bushing 30 and/or the material forming the first spindle element 200, the first spindle element 200 can be in frictional engagement with the bushing 30 so that the first spindle element 200 be substantially fixedly inserted in the bushing 30, with the wider section 230 (or proximal portion 230—identified in FIG. 1) being in contact with the inner surface of the bushing 30 near the first end 34, and the narrower section 250 (also identified in FIG. 1) being in contact with the edge of the bushing's wall 40, the edge of the wall 40 delimiting the bushing's opening/hole 42. The assembly formed by the bushing 30 and the first spindle element 200 of the spindle assembly 100 can thus be fixed with respect to the roll 20 (i.e. the assembly of the bushing 30 and the first spindle element 200 can be prevented from rotating relative to the roll 20 around the central axis X1 once in place in the central cavity 26), in which case the roll rotates in the dispenser via a first dispenser mounting portion 210 of the first spindle element 200 (identified in FIG. 1) on one side, and via a second dispenser mounting portion 310 of the second spindle element 300 on the other side, as will be described in more detail below.

First Spindle Element: Bushing-Engaging Member

Referring to FIGS. 1 to 6, the first spindle element 200 (or first roll-supporting member 200 or bushing-engaging member 200) defines a central axis extending substantially parallel to the central axis X1 of the web material roll 20 (for instance substantially coinciding with the central axis X1 of the roll 20 of web material) when the first spindle element 200 is at least partially engaged in the bushing 30 and/or in the central cavity 26 of the roll 20.

The first spindle element 200 has a first end 202 (or outer end, in that it is configured to be located outwardly with regards to the central cavity 26 of the roll 20, or proximal end, with regards to the first side 12 of the dispenser 10) and an opposed second end 204 (or inner end, with regards to the central cavity 26 of the roll 20, or distal end, with regards to the first side 12 of the dispenser 10) and comprises a first dispenser mounting portion 210 and a bushing mounting portion 220 (or roll-supporting portion or bushing-engaging portion 220).

The first dispenser mounting portion 210 is removably mountable to the first side 12 of the dispenser 10, and the bushing mounting portion 220 (or roll-supporting portion or bushing-engaging portion 220) is sized and configured to fit in and at least partially connect to the bushing 30 provided in the roll 20 of web material.

First Dispenser Mounting Portion

The first dispenser mounting portion 210 (or first dispenser-connecting portion) forms the first end 202 (or outer end) of the first spindle element 200 and is removably mountable to the first side 12 of the dispenser 10.

Optionally, the first dispenser mounting portion 210 comprises a first shaft 212 receivable in the first guiding rail 14 of the first side 12 or slidably positionable in the first guiding rail 14 of the first side 12. The first shaft 212 is substantially cylindrical.

Figure 12:
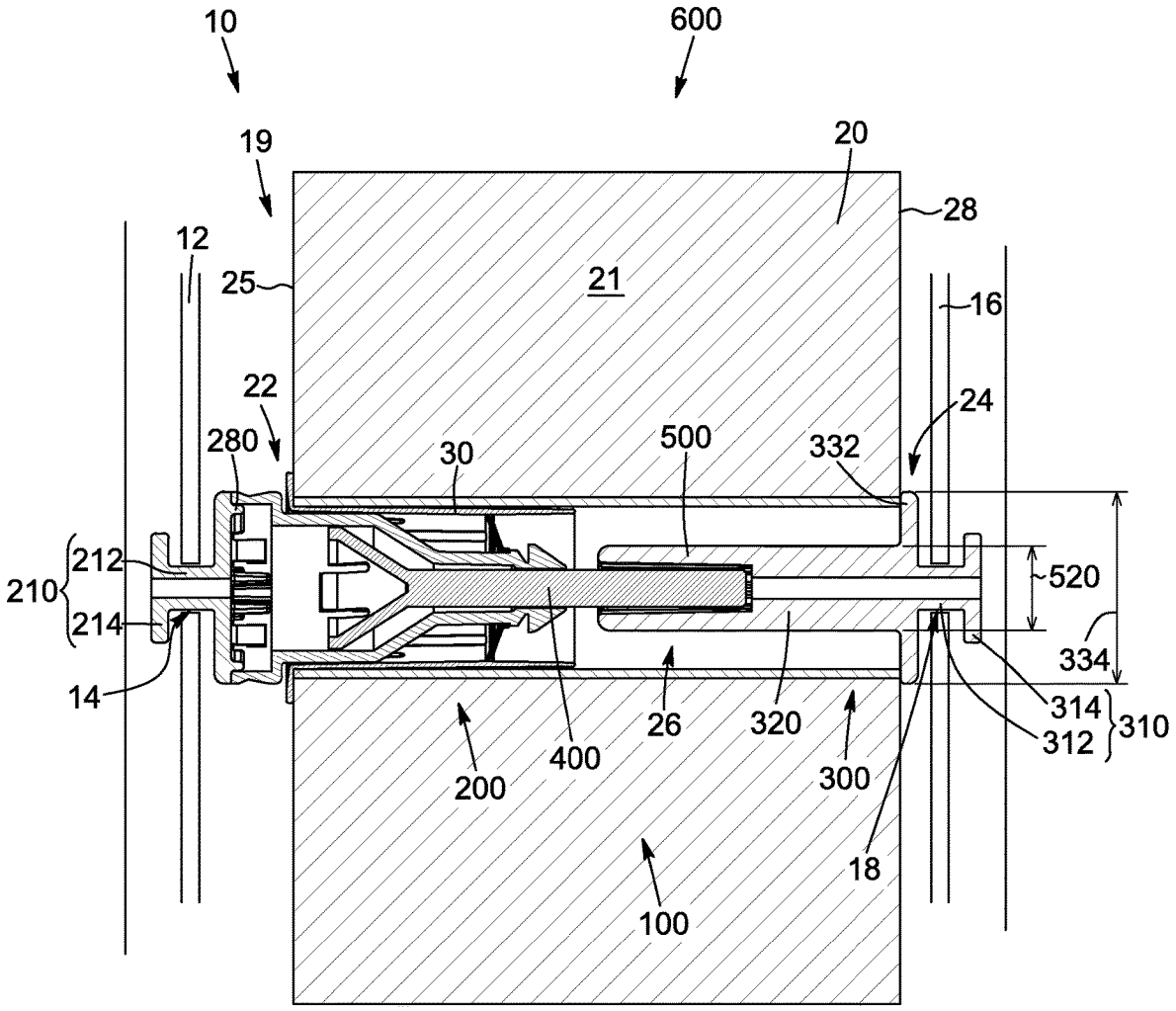
FIG. 12 is a cross-section view of the roll dispensing assembly of FIG. 11, the first and second spindle elements being mounted to first and second sides of a web material dispenser.

The first dispenser mounting portion 210 further comprises a first blocking disk 214 (or first outer member) forming at least partially the first end 202 of the first spindle element 200. The first shaft 212 extends between the first blocking disk 214 and the bushing mounting portion 220. The first blocking disk 214 presents a cross-section greater than a cross-section of the first shaft 212 so that, when the first shaft 212 is received in the first guiding rail 14, as illustrated in FIG. 12, the first shaft 212 cannot be moved (for instance cannot be translated) along the central axis X1 of the roll 20) for the first dispenser mounting portion 210 to be removed from the first side 12 of the dispenser 10. In other words, the first blocking disk 214 is configured to abut against a portion of the first side 12 of the dispenser 10 (for instance to abut against a portion of an outer face of the first side 12, considered with respect to the dispenser cavity 19 of the web material dispenser 10) when the first spindle element 200 is mounted to the first side 12 and is translated inwardly along a direction substantially parallel to the central axis X1 of the roll 20. Even though in the embodiment shown, as represented in FIG. 12, the first blocking disk 214 extends proximate to the outer face of the first side 12 of the dispenser 10 when the first spindle element 200 is mounted thereto, a first spindle element 200 dimensioned so that the first blocking disk 214 would be spaced apart from the first side 12 of the dispenser 10 when mounted thereto could also be conceived. A first spindle element 200 having no first blocking disk 214 could also be conceived.

It is appreciated that the shape and the configuration of the first dispenser mounting portion 210, and more particularly the shape and configuration of the first shaft 212 and the first blocking disk 214, can vary from the embodiment shown.

In the second embodiment of the spindle assembly 700 represented in FIGS. 13 to 19, the first spindle element 800 (or bushing-engaging member 800) also comprises a first dispenser mounting portion 810 and a bushing-engaging portion 820. The first dispenser mounting portion 810 further comprises a first spacing element 811 removably mounted to the first shaft 812. The first spacing element 811 is shaped and dimensioned to increase a cross-section of the part of the first dispenser mounting portion 810 configured to be mounted to the first side 12 (for instance the part of the first dispenser mounting portion 810 configured to be at least partially received in the first guiding rail 14) for the first dispenser mounting portion 810 to be adapted to web material dispensers having first guiding rails of different dimensions. The first spacing element 811 is shaped and dimensioned to surround at least partially an outer periphery of the first shaft 812. The first spacing element 811 can be made in a material different from a material forming the first shaft 812, or in a same material. The first spacing element 811 is shaped, dimensioned and configured not to prevent the first dispenser mounting portion 810 from being rotated with respect to the first side 12 of the dispenser 10, upon exertion of a pulling force on the web material 21 of the web material roll 20 (i.e. on a free end of the web material roll 20). In some embodiments (not represented), the dispenser might be configured to receive upper and lower web material rolls 20 in a superposed configuration (i.e. the upper web material roll is engaged with upper portions of the first and second sides of the dispenser, whereas the lower web material roll is engaged with lower portions of the first and second sides). The dispenser might further comprise a restraining assembly configured to maintain the upper web material roll engaged with the upper portions of the first and second sides until the lower web material roll is empty; once the lower web material roll is empty, the upper web material roll is driven downwardly for its web material to be dispensed. The first spacing element 811 might thus be shaped and dimensioned so as to prevent the upper web material roll from being driven downwardly before the lower web material roll is empty.

Bushing Mounting Portion (or Bushing-Engaging Portion)

The bushing mounting portion 220 (or roll-supporting portion or bushing-engaging portion) comprises, inwardly along the central axis (with regards to the roll receiving cavity 19 or dispenser cavity 19 of the dispenser 10), a proximal portion 230 proximate to the first dispenser mounting portion 210, a central portion 240, a distal portion 250 and a free end 260. In the embodiment shown, a cross-section of the bushing-engaging portion 220 decreases from the proximal portion 230 towards the free end 260.

In the embodiment shown, the proximal portion 230 and the distal portion 250 are both substantially cylindrical. The proximal portion 230 has a cross-section 232 that is greater than a cross-section 252 of the distal portion 250.

The central portion 240 is thus located between the proximal portion 230 and the distal portion 250. For instance, the central portion 240 has a substantially truncated cone shape: a cross-section of the central portion 240 decreases from a first extremity (or proximal extremity) proximate to the proximal portion 230 towards a second extremity (or distal extremity) proximate to the distal portion 250.

The first spindle element 200 further comprises a head 270 (for instance a tapered head 270) bulging at the free end 260. In other words, the head 270 is tapered and has a cross-section decreasing from a first extremity (or outer extremity, with regards to the roll receiving cavity 19 of the dispenser 10) proximate to the distal portion 250 towards an opposed second extremity (or inner extremity). A shoulder 272 (FIG. 10) is thus formed between the bulging tapered head 270 and the distal portion 250.

The bushing mounting portion 220 defines a rod receiving cavity 278. In the embodiment shown, the rod receiving cavity 278 extends at least partially along the proximal portion 230, the central portion 240, the distal portion 250 and the free end 260, and the rod receiving cavity 278 opens onto the free end 260. The bushing mounting portion 220 further comprises first and second blocking windows 234, 236 (or first and second blocking members) formed in a peripheral wall of the proximal portion 230. Optionally, the first and second blocking members 234, 236 comprise substantially rectangular windows formed at two distinct longitudinal positions—considered along the central axis X1 when the spindle assembly 100 is mounted to the web material roll 20—of the bushing mounting portion 220.

It is appreciated that the shape and the configuration of the bushing mounting portion 210, and more particularly the shape, the configuration and the relative location of the proximal portion 230, the central portion 240, the distal portion 250, the head 270 forming the free end 260 and the rod receiving cavity 278 formed therein can vary from the embodiment shown. The shape, number, configuration and location of the first and second blocking windows 234, 236 might also vary from the embodiment shown. For instance, non-through recesses could be formed in the peripheral wall of the proximal portion 230.

Figure 13:
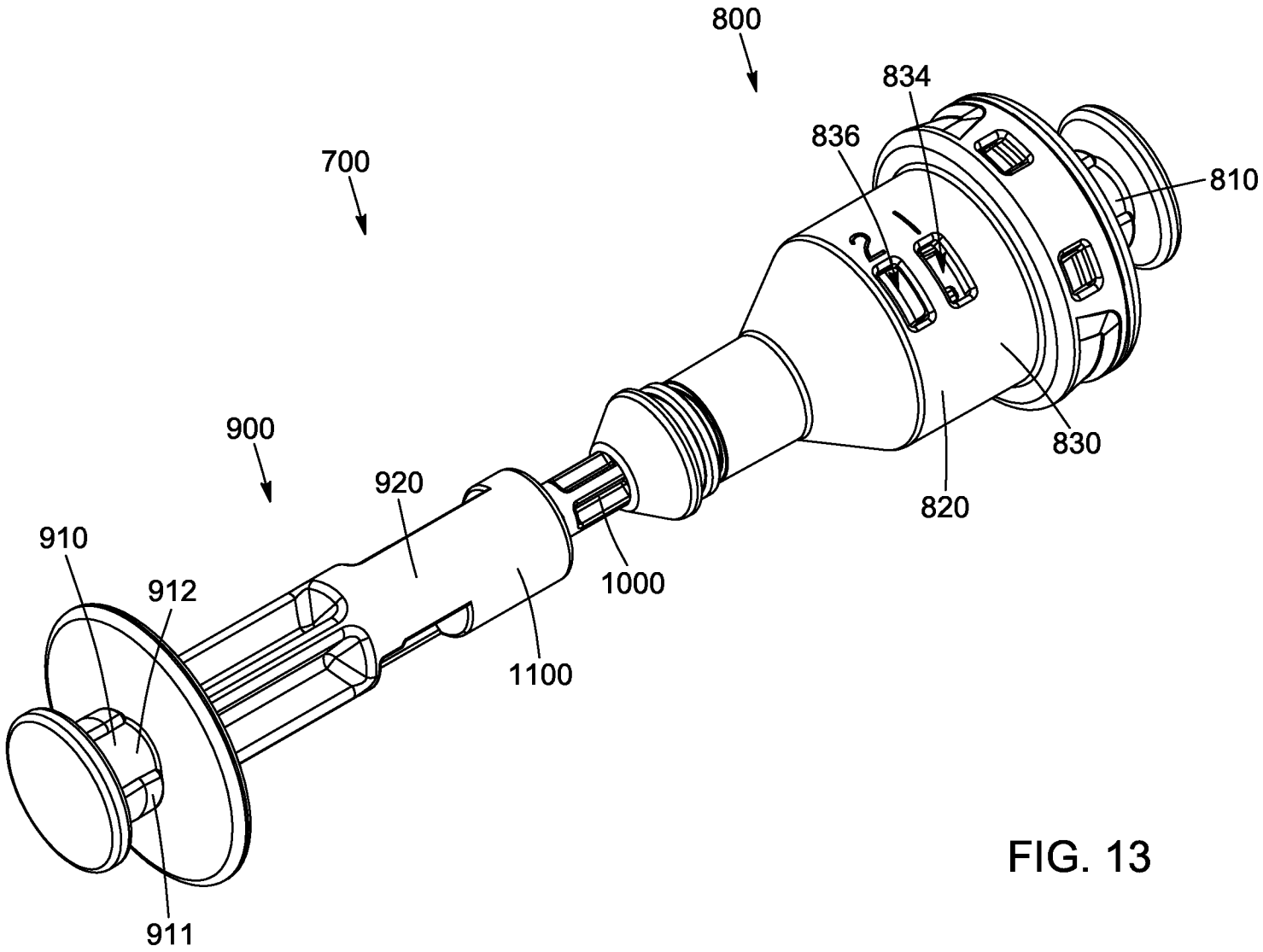
FIG. 13 is a left perspective view of a spindle assembly in accordance with another embodiment, the first and second spindle elements being configured in the assembled configuration.

For instance, as represented in FIG. 13, the bushing-engaging portion 820 of the first spindle element 800 also comprises first and second blocking windows 834, 836 formed in the peripheral wall of the proximal portion 830. The first spindle element 800 further comprises visual indications proximate the first and second blocking windows 834, 836 (for instance numerals).

Connection Assembly: Assembling Rod

In the embodiment shown, the spindle assembly 100 further comprises a connection assembly configured to connect together the first and second spindle elements 200, 300 when configured in the assembled configuration.

The connection assembly firstly comprises an assembling rod 400 of the first spindle element 200 extending from the free end 260 of the bushing mounting portion 220.

The assembling rod 400 comprises a free end 402 forming the second end 204 (or inner end or distal end, considered with respect to the first side 12 of the web material dispenser 10) of the first spindle element 200. Optionally, the free end 402 has a substantially cylindrical shape and extends in a direction substantially parallel to the central axis X1 of the roll 20, when the first spindle element 200 is engaged in the central cavity 26 of the roll 20. The free end 402 of the assembling rod 400 has a cross-section 403 smaller than the cross-sections 232, 252 of the proximal portion 230 and the distal portion 250 of the bushing mounting portion 220.

The assembling rod 400 further comprises a proximal part 404 (or mounting portion) received in the rod receiving cavity 278 formed in the bushing mounting portion 220, so that only the free end 402 of the assembling rod 400 is visible from the outside of the first spindle element 200 and protrudes from the head 270 of the bushing mounting portion 220. As represented in FIGS. 9 and 10, the proximal part 404 comprises a mounting base 406 optionally having a substantially truncated shape, for the mounting base 406 to substantially fit in the portion of the rod receiving cavity 278 formed in the central portion 240 of the bushing mounting portion 220. The mounting base 406 further comprises at least a blocking tongue 408 (or blocking piece) having a blocking end 409 dimensioned to be selectively received in each of the first and second blocking windows 234, 236 (or to cooperate with the first and second blocking members) of the bushing mounting portion 220.

Figure 2:
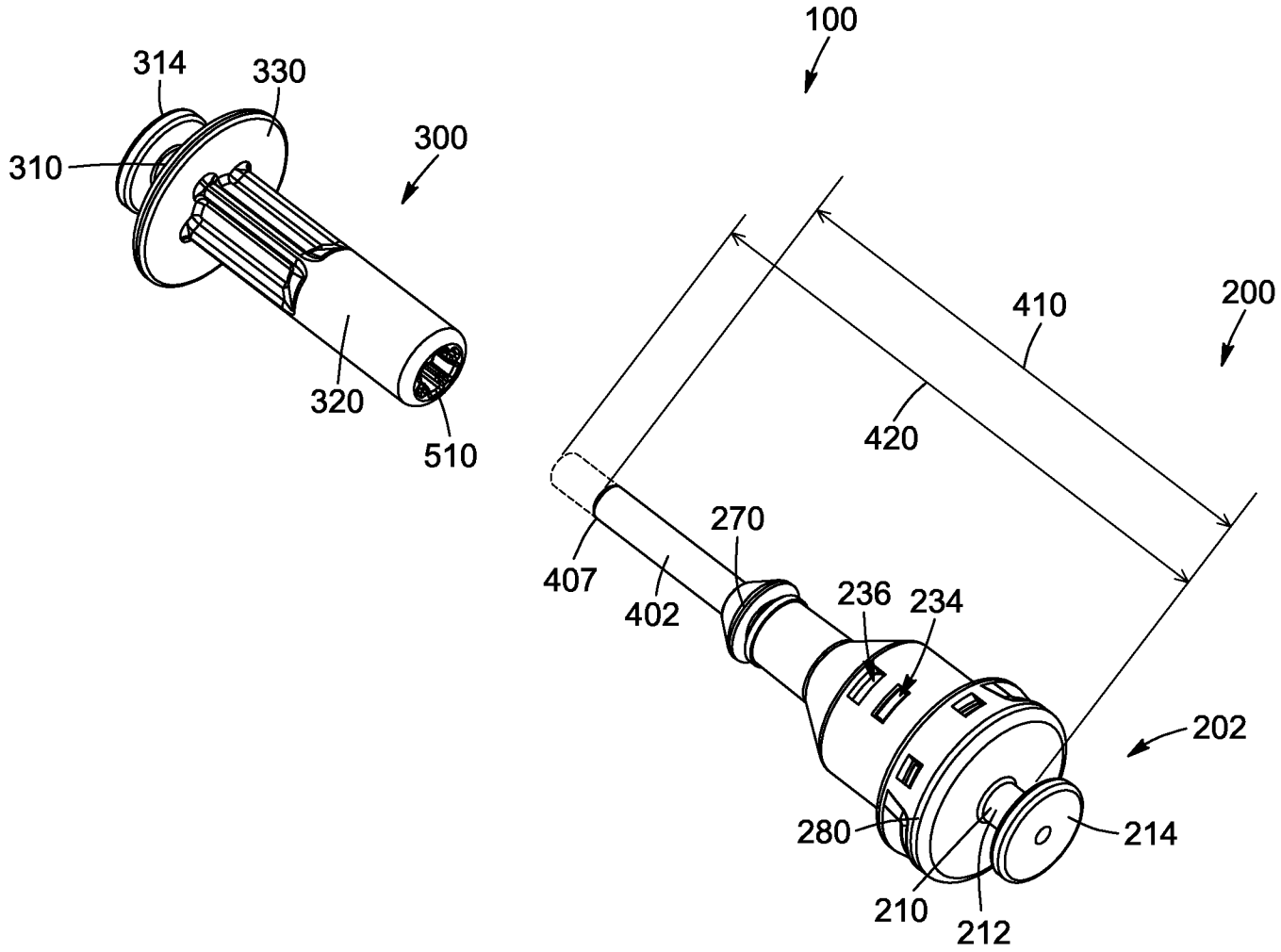
Figure 3:
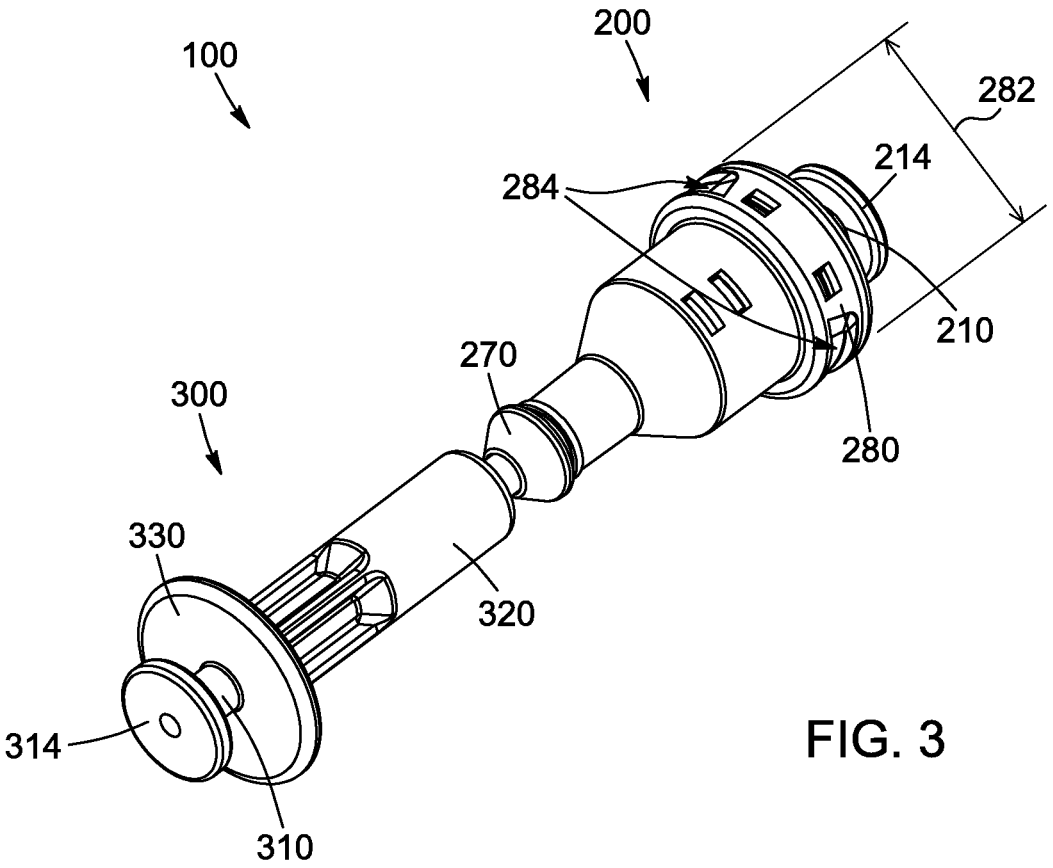
FIGS. 3 and 4 are right and left perspective views of the spindle assembly of FIGS. 1 and 2, the first and second spindle elements being configured in an assembled configuration.
Figure 4:
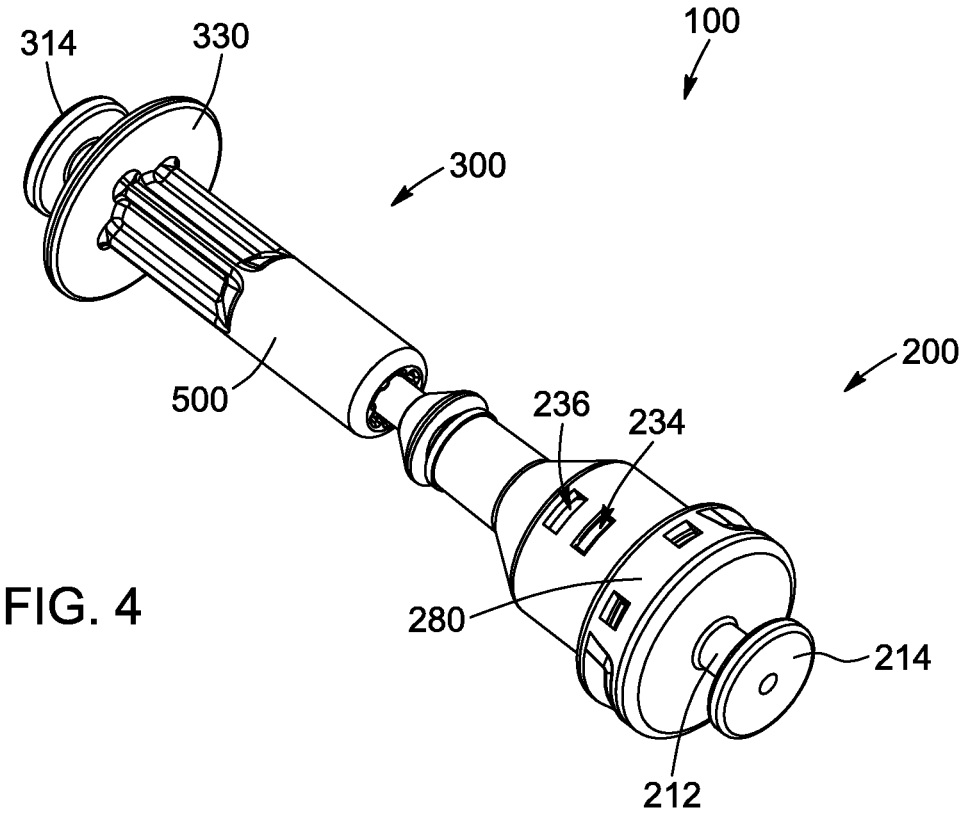

It is thus understood that the assembling rod 400 is configurable into a first configuration (or retracted configuration), as represented in solid lines in FIG. 2, in which the blocking end 409 of the blocking tongue 408 is received in the first blocking window 234. When configured in the first configuration (or retracted configuration), the free end 402 of the assembling rod 400 is at a first distance 410 from the first dispenser mounting portion 210 (the first distance 410 corresponding to the distance between a distal extremity 407 of the free end 402 and the first blocking disk 214). The assembling rod 400 is further configurable into a second configuration (or extended configuration), as represented in dotted lines in FIG. 2, in which the blocking end 409 of the blocking tongue 408 is received in the second blocking window 236. When configured in the second configuration (or extended configuration), the free end 402 of the assembling rod 400 is at a second distance 420 from the first dispenser mounting portion 210. The second distance 420 is greater than the first distance 410. In some embodiments, the second distance 420 is less than about 95% of the first distance 410. In some other embodiments, the second distance 420 is less than about 92% of the first distance 410. In yet some other embodiments, the second distance 420 is equal to or smaller than about 90% of the first distance 410.

It is thus understood that the first blocking window 234 and the blocking tongue 408, on the one hand, and the second blocking window 236 and the blocking tongue 408, on the other hand, form first and second blockers to block the assembling rod 400 respectively in the first and second configurations. By removing the blocking tongue 408 from one of the first and second blocking windows 234, 236, displacing the assembling rod 400 in the rod receiving cavity 278, and placing the blocking tongue 408 in the other one of the first and second blocking windows 234, 236, it is easy to configure the assembling rod 400 from one of the first and second configurations to the other one of the first and second configurations.

Similarly, the first spindle element 800 of the spindle assembly 700 in accordance with the second embodiment also comprises an assembling rod 1000 configurable into first and second configurations (or retracted and extended configurations). The assembling rod 1000 comprises a blocking tongue 1008 (FIGS. 17 and 18) selectively engageable in the first and second blocking windows 834, 836. The use of visual indicators proximate to the first and second blocking windows 834, 836 allows to easily identify in which of the first and second configurations the assembling rod 1000 is configured.

It is appreciated that the shape, the configuration, and the location of the first and second blockers can vary from the embodiments shown, as long as they allow an easy axial or longitudinal positioning and blocking of the assembling rod 400, 1000 with regards to the first mounting portion 210, 810. It could also be conceived a first spindle element 200, 800 in which the assembling rod 400, 1000 could be configurable into more than two discrete positions.

Figures 17, 18:
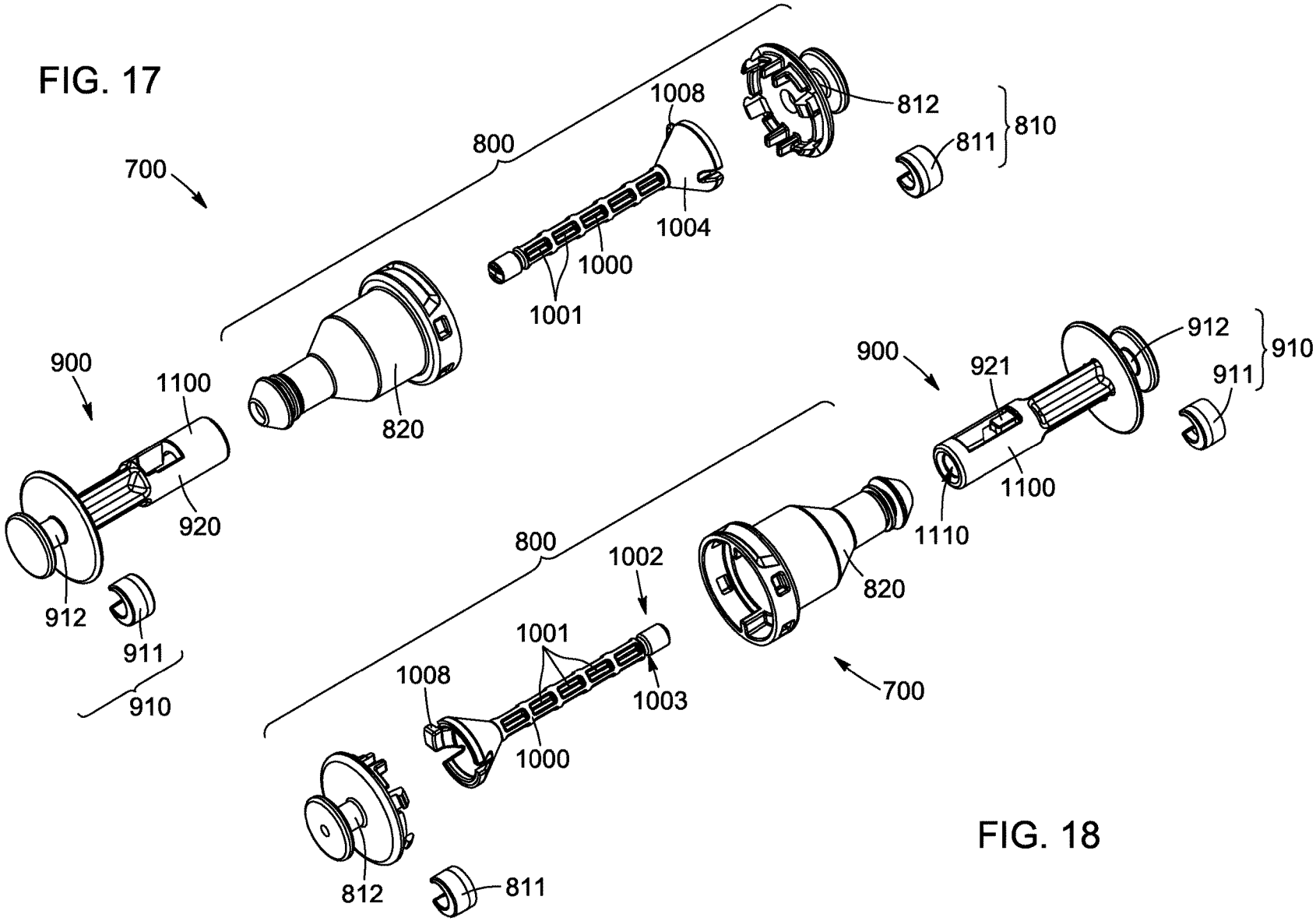
FIGS. 17 and 18 are right and left perspective exploded views of the first and second spindle elements of the spindle assembly of FIG. 13.
Figure 19:
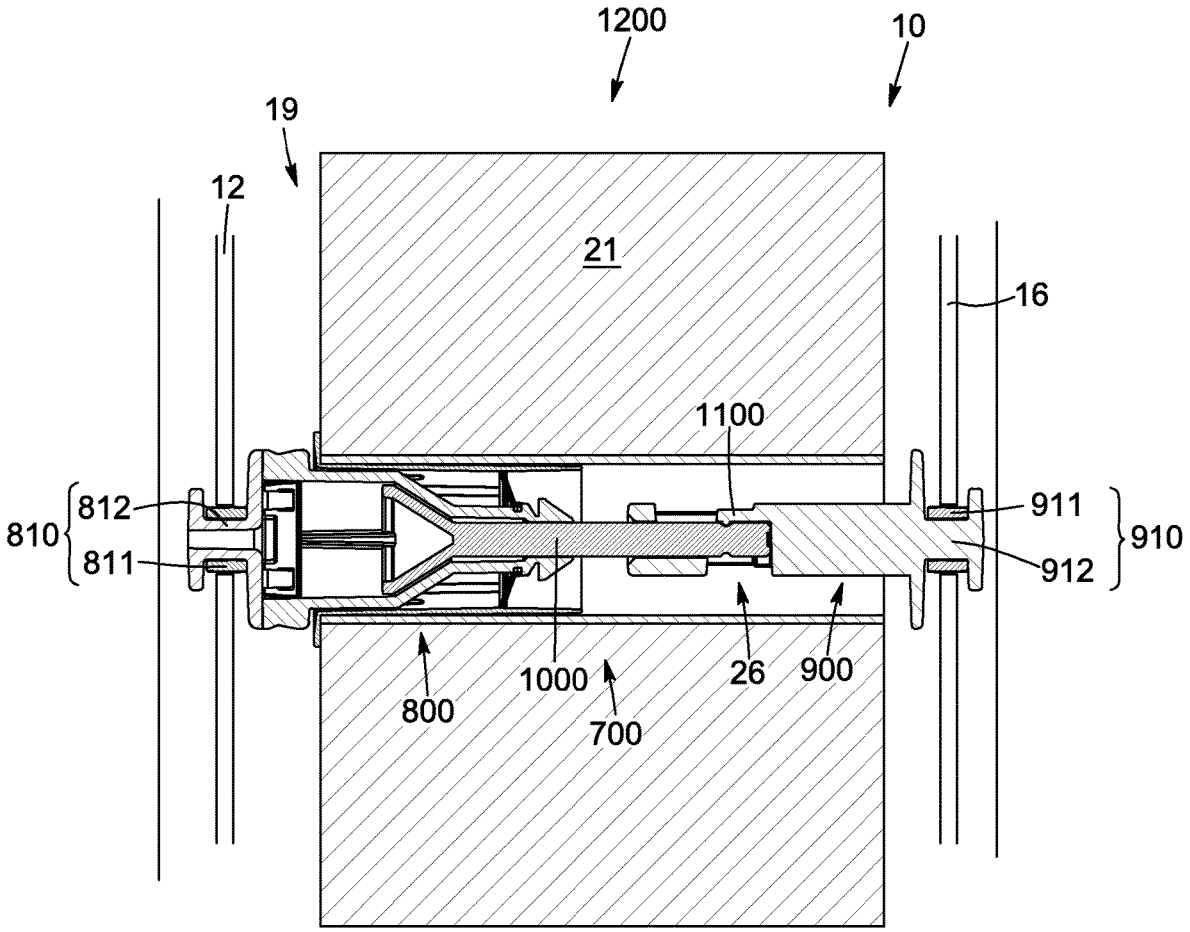
FIG. 19 is a cross-section view of the roll dispensing assembly of FIG. 13, the first and second spindle elements being mounted to the first and second sides of the web material dispenser.

Moreover, it is appreciated that the shape and the configuration of the assembling rod 400, 1000 and more particularly the shape and the configuration of the free end 402, 1002 and the proximal part 404, 1004, can vary from the embodiment shown. For instance, as represented in FIGS. 17 and 18, recesses 1001 can be formed in the assembling rod 1000, to reduce a weight of the first spindle element 800 and/or to ease the manufacturing of the first spindle element 800.

Additional Features of the First Spindle Element

The first spindle element 200 further comprises a first abutting portion 280 (or first handling portion or first insertion-limiting portion or first engagement-limiting portion) located between the bushing mounting portion 220 and the first dispenser mounting portion 210. In other words, the first abutting portion 280 and the first blocking disk 214 form two axially spaced enlargements at the first dispenser mounting portion 210. It is appreciated that the shape and the number of the axially spaced enlargements can vary from the embodiment shown.

Optionally, the first abutting portion 280 is substantially cylindrical and has a cross-section 282 greater than the cross-section 232 of the proximal portion 230, and thus greater than the cross-section 252 of the distal portion 250. The cross-section 282 of the first abutting portion 280 is greater, in the embodiment shown, than a cross-section of the first blocking disk 214. The cross-section 282 of the first abutting portion 280 is also greater that the cross-section 27 of the central cavity 26, so that the first abutting portion 280 abuts against the lateral side 25 of the roll 20 when the assembling rod 400 is engaged into the bushing 30 provided in the central cavity 26 of the roll 20. The first abutting portion 280 thus limits the engagement of the first spindle element 200 into the bushing 30 provided in the central cavity 26 of the roll 20. Optionally, when the bushing 30 comprises the outside collar 38 configured to limit the insertion of the bushing 30 into the central cavity 26, the first abutting portion 280 of the first spindle element 200 abuts against the outside collar 38 when the first spindle element 200 is inserted into the bushing 30. In other words, the outside collar 38 is sandwiched between the first abutting portion 280 and the web material 21 (the first lateral side 25 of the web material roll 20, in the embodiment shown).

Grapping recesses 284, for instance substantially trapezoidal, are formed in the first abutting portion 280, that are configured to ease the handling of the first spindle element 200.

Optionally, a recess (or groove or peripheral recess) 274 is formed in the bushing mounting portion 220 of the first spindle element 200, behind the head 270. In other words, the recess 274 is formed between the distal portion 250 and the head 270. The recess 274 extends along at least a portion of an outer periphery of the bushing mounting portion 220, optionally along substantially the entirety, i.e. along all of the outer periphery of the bushing mounting portion 220. As shown, the recess 274 can define a substantially truncated portion extending between a front end of the distal portion 250 and a rear end of the head 270. In other words, the recess 274 is shaped and dimensioned so that the cross-section of the bushing mounting portion 220 regularly decreases between the front end of the distal portion 250 and the rear end of the head 270. It is however appreciated that the shape and the dimensions of the recess 274 can vary from the embodiment shown.

The recess 274 is configured so that, when the first spindle element 200 is removed from the roll 20 of web material with the bushing 30 inserted therein, the wall 40 is at least partially received in the recess 274. Thus, the abutment surface of the substantially vertically extending face formed between the front end of the distal portion 250 and the tapered head 270 (i.e. at the shoulder 272 formed between the bulging head 270 and the distal portion 250) against the wall 40 of the bushing 30 is increased. Consequently, breaking of the wall 40 of the bushing 30 upon removal of the first spindle element 200 is facilitated. In other words, the recess 274 eases breaking of the wall 40 when the first spindle element 200 is forced out of the bushing 30.

Moreover, as represented for instance in FIGS. 9 and 10, the bushing mounting portion 220 further comprises a blocking protrusion 276 (comprising for instance a blocking ring) mounted to the front end of the distal portion 250. The blocking protrusion 276 extends from an outer surface of the bushing-engaging portion 220 (an outer surface of the distal portion 250 thereof, in the embodiment shown). The blocking protrusion 276—or peripheral protrusion—extends along at least a portion of an outer periphery of the distal portion 250. Optionally, the blocking protrusion 276 extends along substantially the entirety of the outer periphery of the distal portion 250. The blocking protrusion 276 might be integrally formed with the bushing mounting portion 220, and more particularly with its distal portion 250. It is appreciated that the shape and the dimensions of the blocking protrusion 276 can vary from the embodiment shown.

It is thus understood that, considered along the central axis of the bushing mounting portion 220 of the first spindle element 200 towards the free end 260, an outer diameter of the bushing mounting portion 220 increases from the cross-section 252 of the distal portion 250 to the cross-section of the blocking protrusion 276. Then the cross-section of the bushing mounting portion 220 decreases in the recess 274 and then increases when passing the shoulder 272 defined between the distal portion 250 and the tapered head 270.

The blocking protrusion 276 is configured to limit the engagement of the first spindle element 200 in the bushing 30: the blocking protrusion 276 forms a longitudinal blocker to cooperate with the wall 40 of the bushing 30 so as to ensure that, once the first spindle element 200 is introduced in the bushing 30, the first and second bearing surfaces 44, 46 of the bushing 30 are adequately arranged with regards to the first spindle element 200 (and more particularly with regards to the proximal portion 230 and the distal portion 250 of the bushing mounting portion 220), thus resulting in an inadequate dispensing of the web material.

Figure 14:
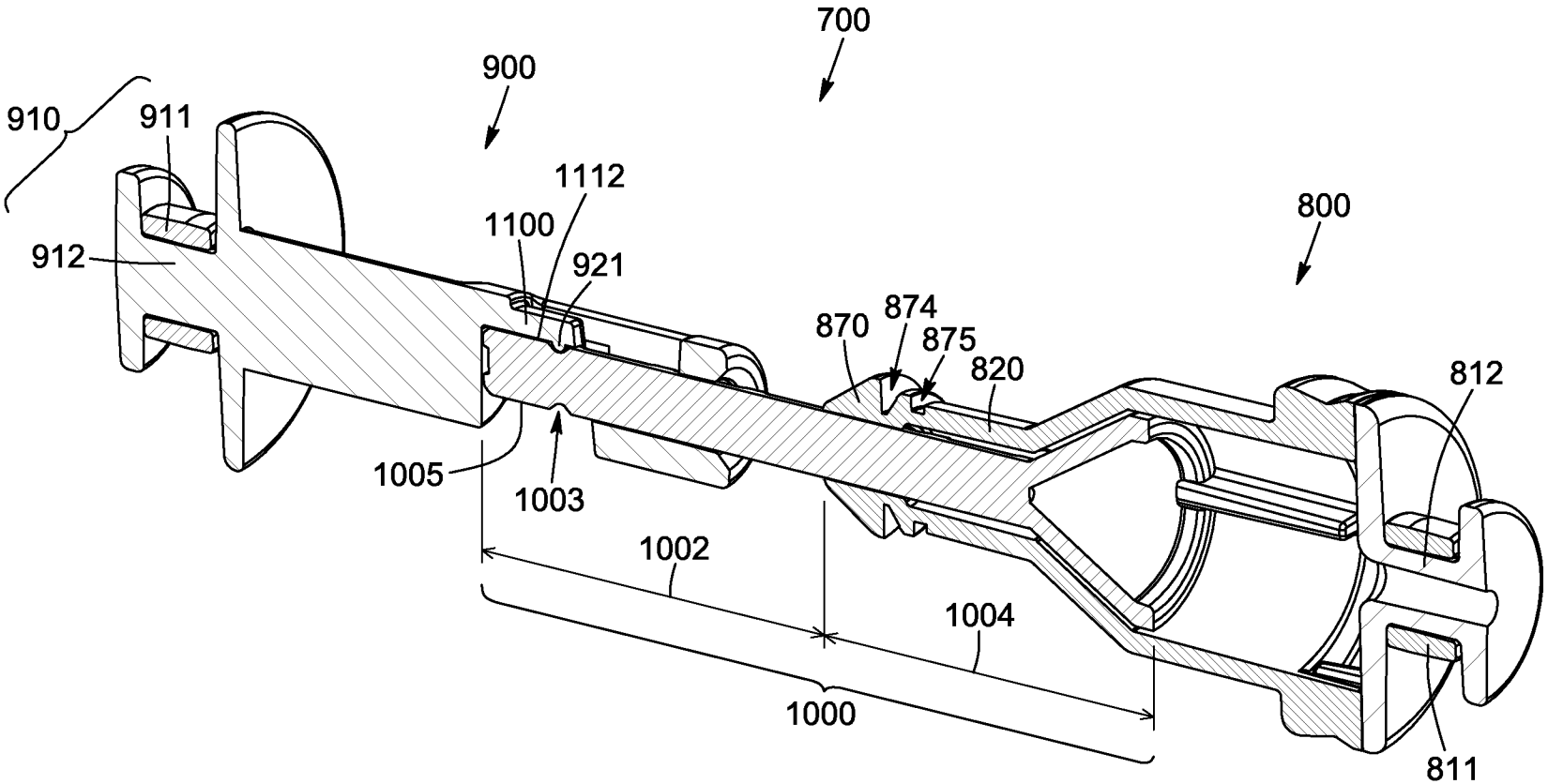
FIG. 14 is a cross-section view, in perspective, of the first and second spindle elements of FIG. 13.
Figure 15:
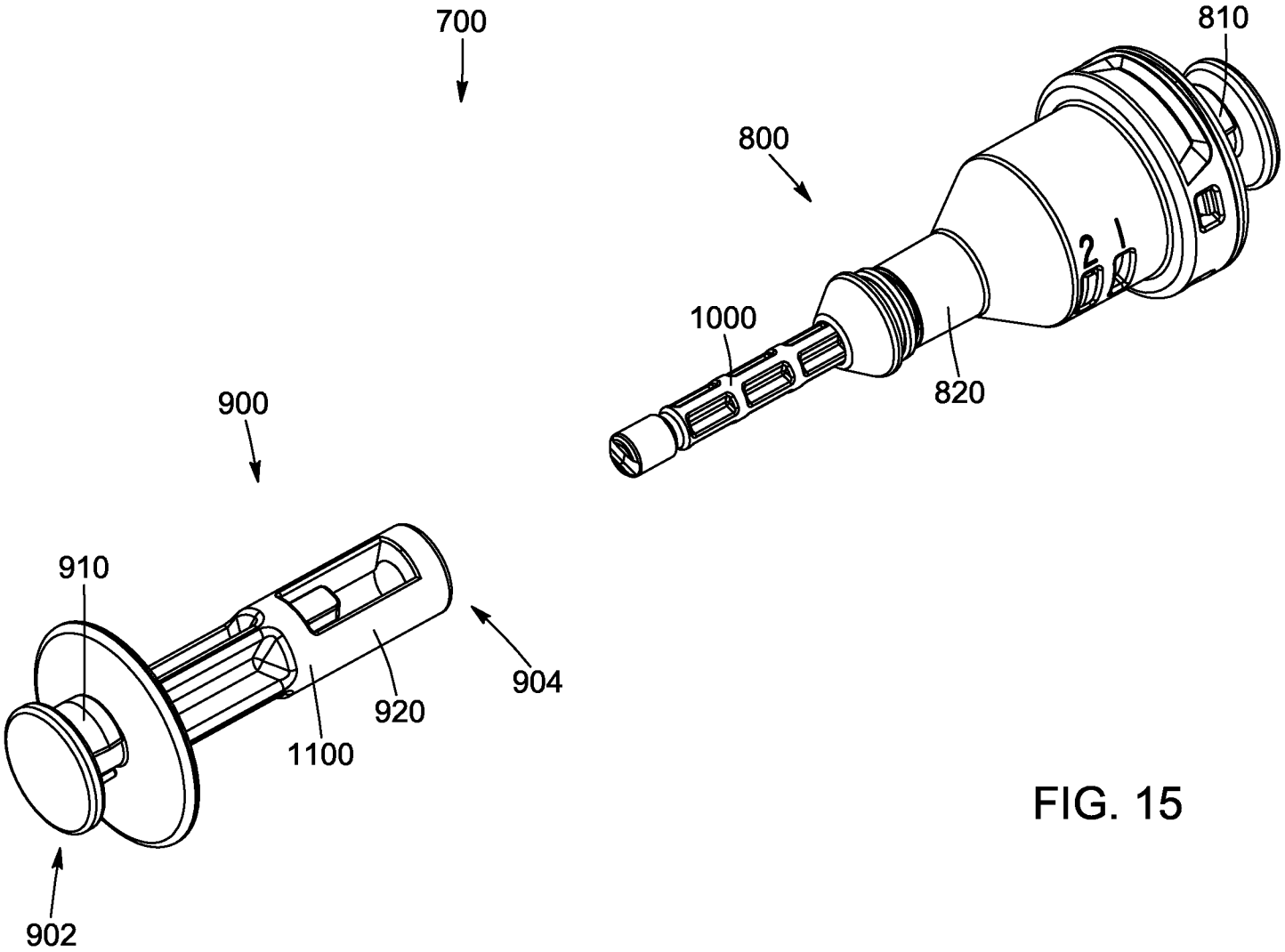
FIGS. 15 and 16 are left and right perspective views of the spindle assembly of FIG. 13, the first and second spindle elements being configured in the disassembled configuration.
Figure 16:
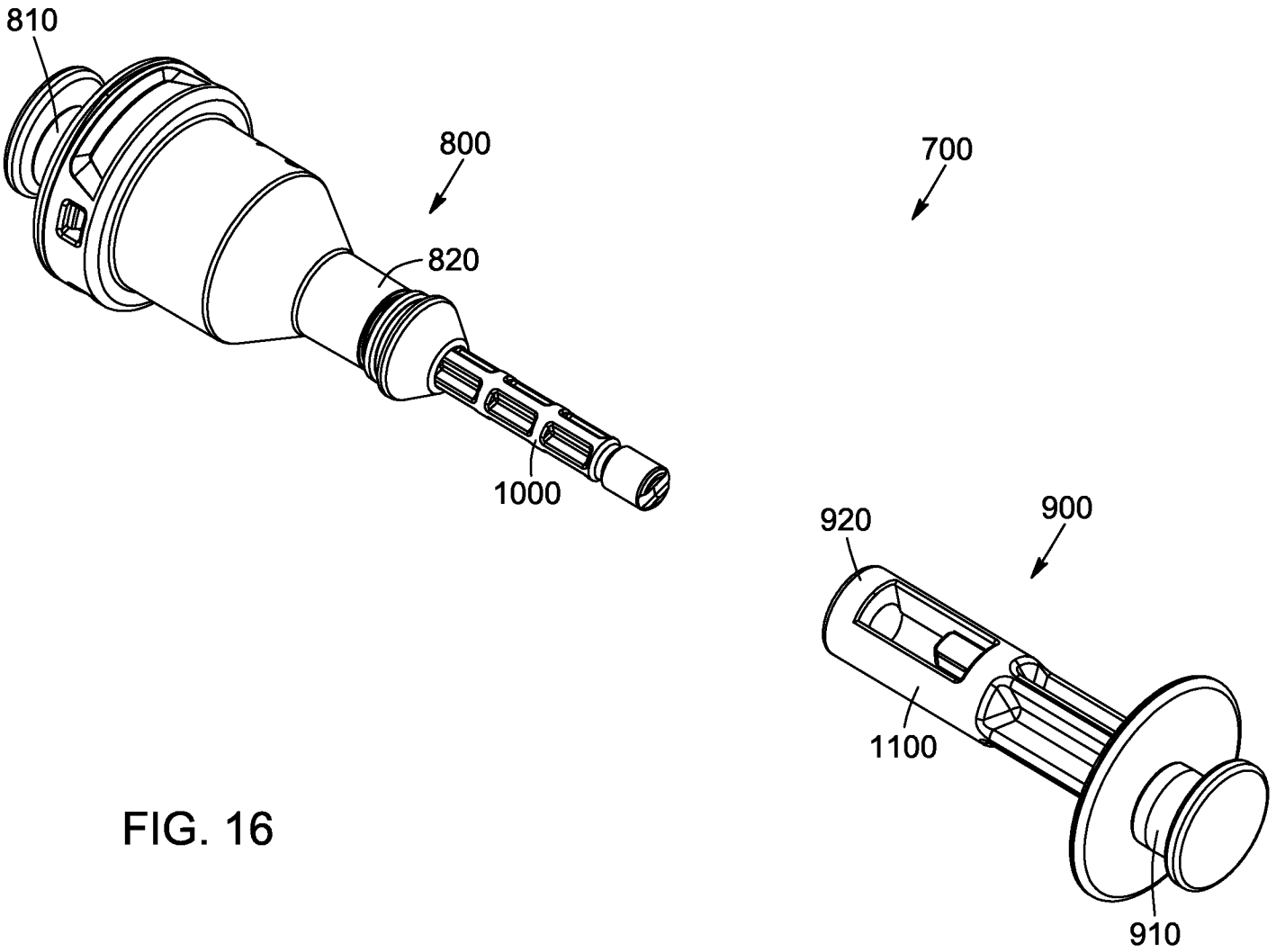

It is appreciated that the shape, the configuration, the relative arrangement and the number of blocking protrusion and peripheral recess can vary from the embodiment shown. For instance, as represented in FIG. 14 of the second embodiment of the spindle assembly 700, a plurality of axially spaced peripheral recesses 874, 875 (two, in the embodiment shown) can be formed in the bushing-engaging portion 820 of the first spindle element 800.

Construction of the First Spindle Element

Figure 5:
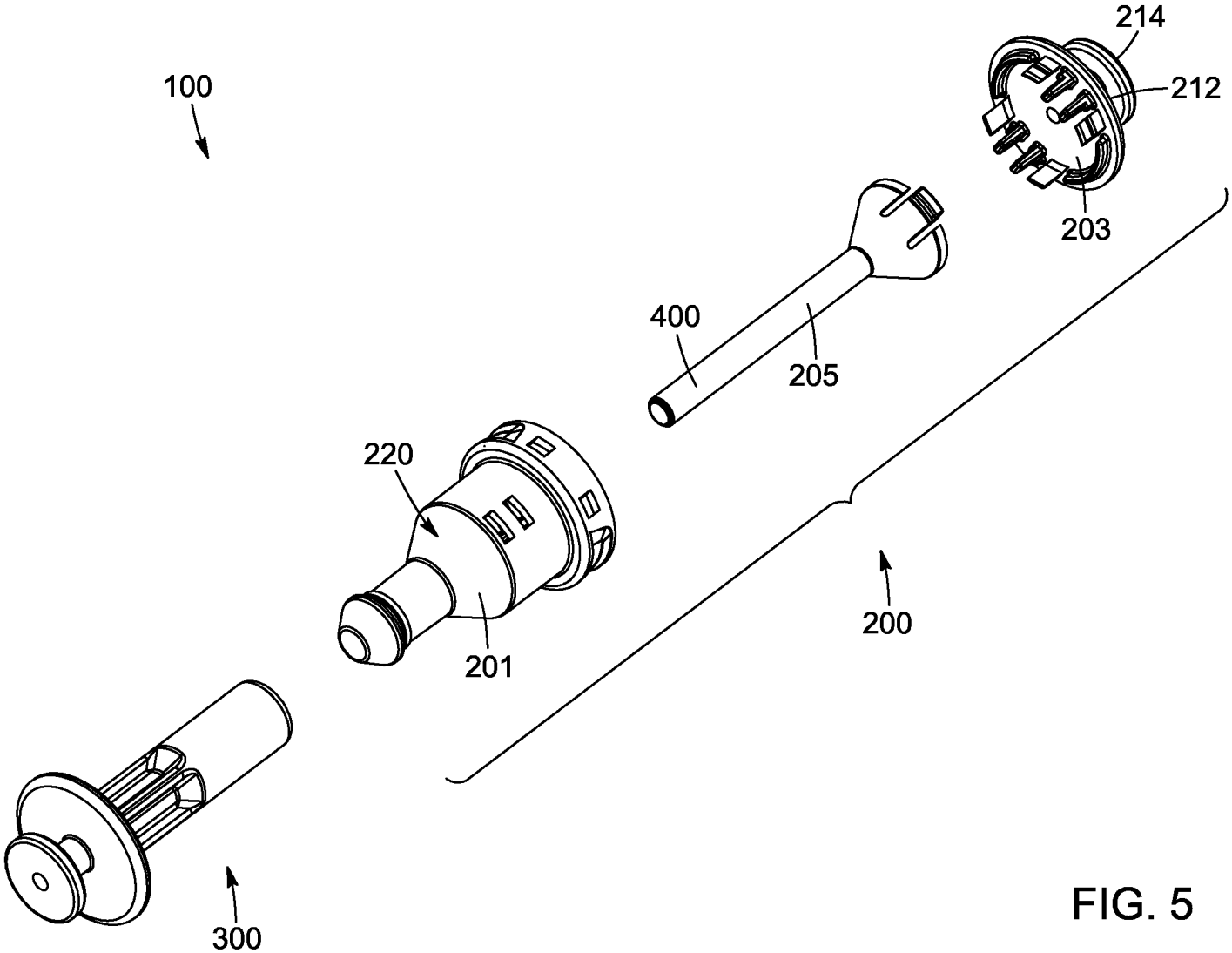
FIGS. 5 and 6 are right and left perspective exploded views of the first and second spindle elements of the spindle assembly of FIGS. 1 and 2.
Figure 6:
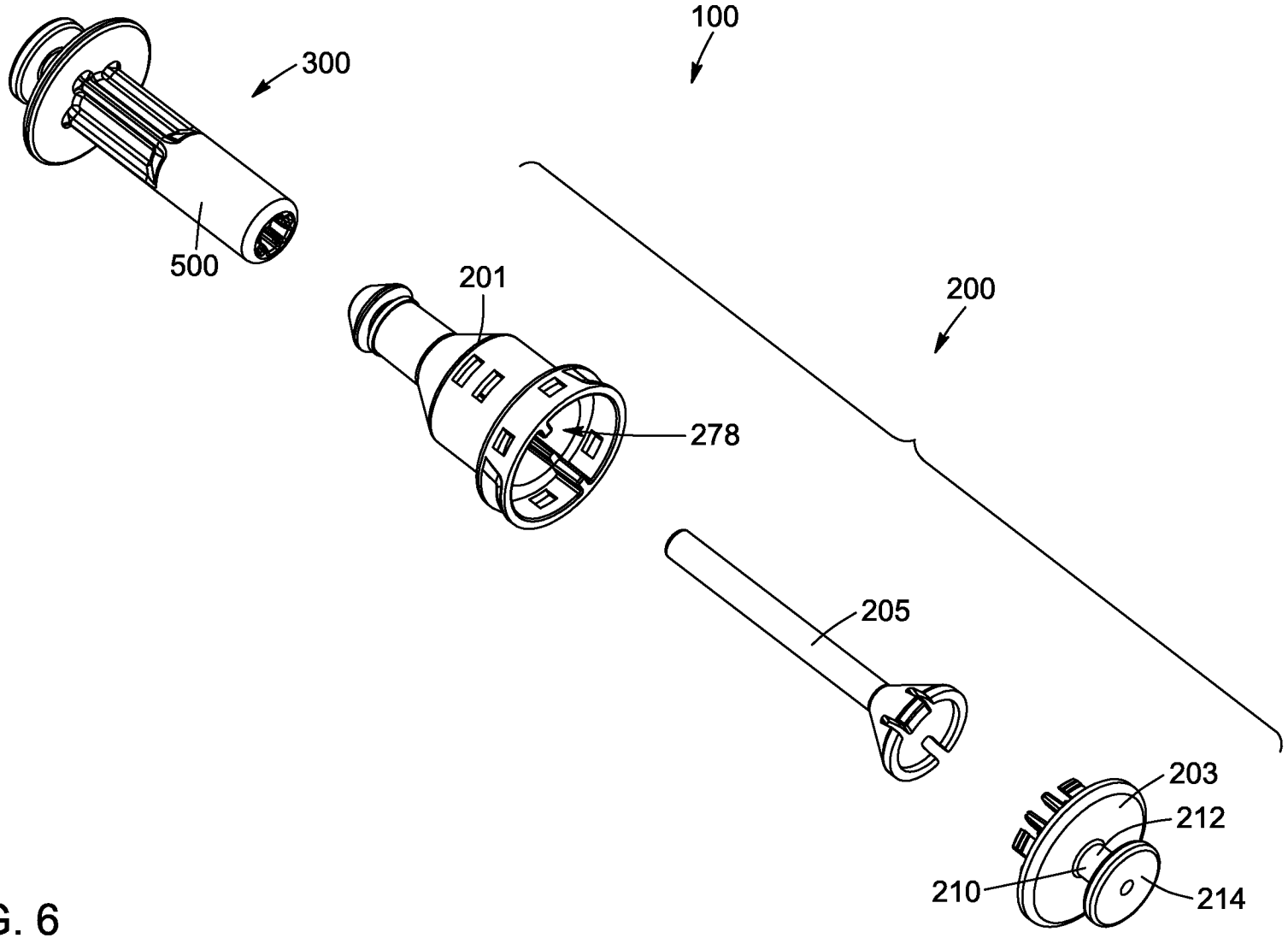

As shown in FIGS. 5 and 6, the first spindle element 200 might be composed of a plurality of distinct elements secured together. For instance, the first spindle element 200 is composed of three distinct elements, at least some of them being partially hollow, connectable together (for instance removable mountable to each other) so as to form the rod receiving cavity 278 when assembled together.

In the embodiment shown, the first spindle element 200 comprises a first piece 201 forming the bushing mounting portion 220 and a portion of the first abutting portion 280. The first spindle element 200 further comprises a second piece 203 forming a complementary portion of the first abutting portion 280 and the first dispenser mounting portion 210. The first and second pieces 201, 203 are detachably mountable to each other, for instance with closing tongues formed on the second piece 203 that are configured to be received in closing windows formed in a portion of the first piece 201, optionally configured to form a peripheral wall of the first abutting portion 280. The first spindle element 200 further comprises a third piece 205 forming the assembling rod 400.

The present disclosure might also concern a kit for forming a first spindle element 200, the kit comprising the first, second and third pieces 201, 203, 205. To form the first spindle element 200, the third piece 205 is firstly introduced in the rod receiving cavity 278 formed in the first piece 201, via an extremity of the first piece 201 opposed to the free end 260. Then the second piece 203 is secured to the first piece 201 so as to maintain the assembling rod 400 in the rod receiving cavity 278. The kit might further comprise the piece(s) forming the second spindle element 300.

It is appreciated that the shape and the configuration of the first spindle element 200, and for instance the shape, configuration, cooperation and number of pieces composing the first spindle element 200 can vary from the embodiment shown.

Second Spindle Element: Spindle Connection Member

Referring to FIGS. 1 to 6, the second spindle element 300 of the spindle assembly 100 (or spindle connection member 300 or second roll-supporting member 300) defines a central axis extending substantially parallel to the central axis X1 of the web material roll 20 (for instance substantially coinciding with the central axis X1 of the web material roll 20 when the second spindle element 300 is at least partially engaged in the central cavity 26 of the roll 20 via the second extremity 24 and mounted to at least one of the second extremity 24 of the web material roll 20 and the first spindle element 200. It is understood that, in particular depending on the shape and dimensions of the first and second spindle elements 200, 300, and depending on whether the second spindle element 300 is directly mounted to the first spindle element 200, the central axis of the second spindle element 300 might be inclined with respect to the central axis X1 of the web material roll 20 when the second spindle element 300 is at least partially engaged in the central cavity 26 of the web material roll 20. In other words, depending on the shape and dimensions of the first and second spindle elements 200, 300, a portion of a weight of the web material roll 20 supported by the first spindle element 200 can differ. In some embodiments, the first spindle element 200 can directly support a major part of the weight of the web material roll 20.

The second spindle element 300 has a first end 302 (or outer end, with regards to the central cavity 26 of the web material roll, or a proximal end, considered with regards to the second side 16 of the dispenser 10, or a dispenser-mounting end) and an opposed second end 304 (or inner end, or distal end or first spindle element-engaging end) and comprises a second dispenser mounting portion 310 and a connecting portion 320 mountable or connectable to at least one of the second extremity 24 of the roll 20 and the first spindle element 200. Even though in the different figures (for instance FIGS. 11 and 12) the second spindle element 300 is in contact with the roll 20 of web material, it could be conceived a spindle assembly wherein the second spindle element would not contact the roll of web material when connected to the first spindle element and/or engaged with the dispenser. The connecting portion 320 extends from the second dispenser mounting portion 310. The second dispenser mounting portion 310 is removably mountable to the second side 16 of the dispenser 10.

Second Dispenser Mounting Portion

The second dispenser mounting portion 310 (or second dispenser-connecting portion) of the second spindle element 300 forms at least partially the first end (or outer end or proximal end) 302 of the second spindle element 300 and is removably mountable to the second side 16 of the dispenser 10.

Optionally, the second dispenser mounting portion 310 comprises a second shaft 312 receivable in the second guiding rail 18 of the second side 16 or slidably positionable in the second guiding rail 18 of the second side 16. The second shaft 312 is substantially cylindrical.

The second dispenser mounting portion 310 further comprises a second blocking disk 314 (or second outer member) forming at least partially the first end 302 of the second spindle element 300. The second shaft 312 extends between the second blocking disk 314 and the connecting portion 320. The second blocking disk 314 presents a cross-section greater than a cross-section of the second shaft 312 so that, when the second shaft 312 is received in the second guiding rail 18, as represented in FIG. 12, the second shaft 312 cannot be moved (for instance cannot be translated) along the central axis X1 of the roll 20 for the second dispenser mounting portion 310 to be removed from the second side 16 of the dispenser 10. In other words, the second blocking disk 314 is configured to abut against a portion of the second side 16 of the web material dispenser 10 (for instance to abut against a portion of an outer face of the second side 16, considered with respect to the dispenser cavity 19 of the web material dispenser 10) when the second spindle element 300 is mounted to the second side 16 and is translated inwardly along a direction substantially parallel to the central axis X1 of the roll 20. Even though in the embodiment shown, as represented in FIG. 12, the second blocking disk 314 extends proximate to the outer face of the second side 16 of the dispenser 10 when the second spindle element 300 is mounted thereto, a second spindle element 300 dimensioned so that the second blocking disk 314 would be spaced apart from the second side 16 of the dispenser 10 when mounted thereto could also be conceived. A second spindle element 300 having no second blocking disk 314 could also be conceived.

It is appreciated that the shape and the configuration of the second dispenser mounting portion 310, and more particularly the shape and configuration of the second shaft 312 and the second blocking disk 314 (or second outer member), can vary from the embodiment shown.

In the second embodiment of the spindle assembly 700 represented in FIGS. 13 to 19, the second spindle element 900 (or spindle connection member 900 or second roll-supporting member 900) also comprises a second dispenser mounting portion 910 and a connecting portion 920. The second dispenser mounting portion 910 further comprises a second spacing element 911 removably mounted to the second shaft 912. The second spacing element 911 is shaped and dimensioned to increase a cross-section of the part of the second dispenser mounting portion 910 configured to be mounted to the second side 16 (for instance the part of the second dispenser mounting portion 910 configured to be at least partially received in the second guiding rail 18) for the second dispenser mounting portion 910 to be adapted to web material dispensers having second guiding rails of different dimensions. The second spacing element 911 is shaped and dimensioned to surround at least partially an outer periphery of the second shaft 912. The second spacing element 911 can be made in a material different from a material forming the second shaft 912, or in a same material. Similarly to the above-described first spacing element 811, the second spacing element 911 is shaped, dimensioned and configured not to prevent the second dispenser mounting portion 910 from rotated with respect to the second side 16 of the dispenser 10, upon exertion of a pulling force on the web material 21 of the web material roll 20 (i.e. on the free end of the web material roll 20) and/or to prevent the upper web material roll from being driven downwardly before the lower web material roll is empty, in the above-mentioned embodiment in which the dispenser is configured to receive the upper and lower web material rolls in a superposed configuration.

Connection Assembly: Connection Portion—Assembling Sleeve

In the embodiment shown, the connection assembly of the spindle assembly 100 further comprises the connection portion 320 configured to connect together the first and second spindle elements 200, 300 when configured in the assembled configuration.

As illustrated, in the embodiment shown, the connection portion 320 comprises an assembling sleeve 500 defining an assembling cavity 510 to receive the assembling rod 400 of the first spindle element 200 for the first and second spindle elements 200, 300 to be connected together when configured in the assembled configuration, thereby allowing use of the roll 20 of web material with the bushing 30 therein in the dispenser 10. It could also be conceived a second spindle element 300 having a connection portion 320 that would be configured to be only or additionally mountable to the second extremity 24 of the roll 20. In other words, the assembling rod 400 and the connection portion 320 form together the connection assembly of the spindle assembly 100 configured to connect together the first and second elements 200, 300 of the spindle assembly 100 when configured in the assembled configuration.

Optionally, the assembling cavity 510 is substantially cylindrical and defines a central axis. In some embodiments, the central axis of the assembling cavity 510 substantially coincides with the central axis X1 of the web material roll 20 when the second spindle element 200 is at least partially engaged in the central cavity 26.

Figure 7:
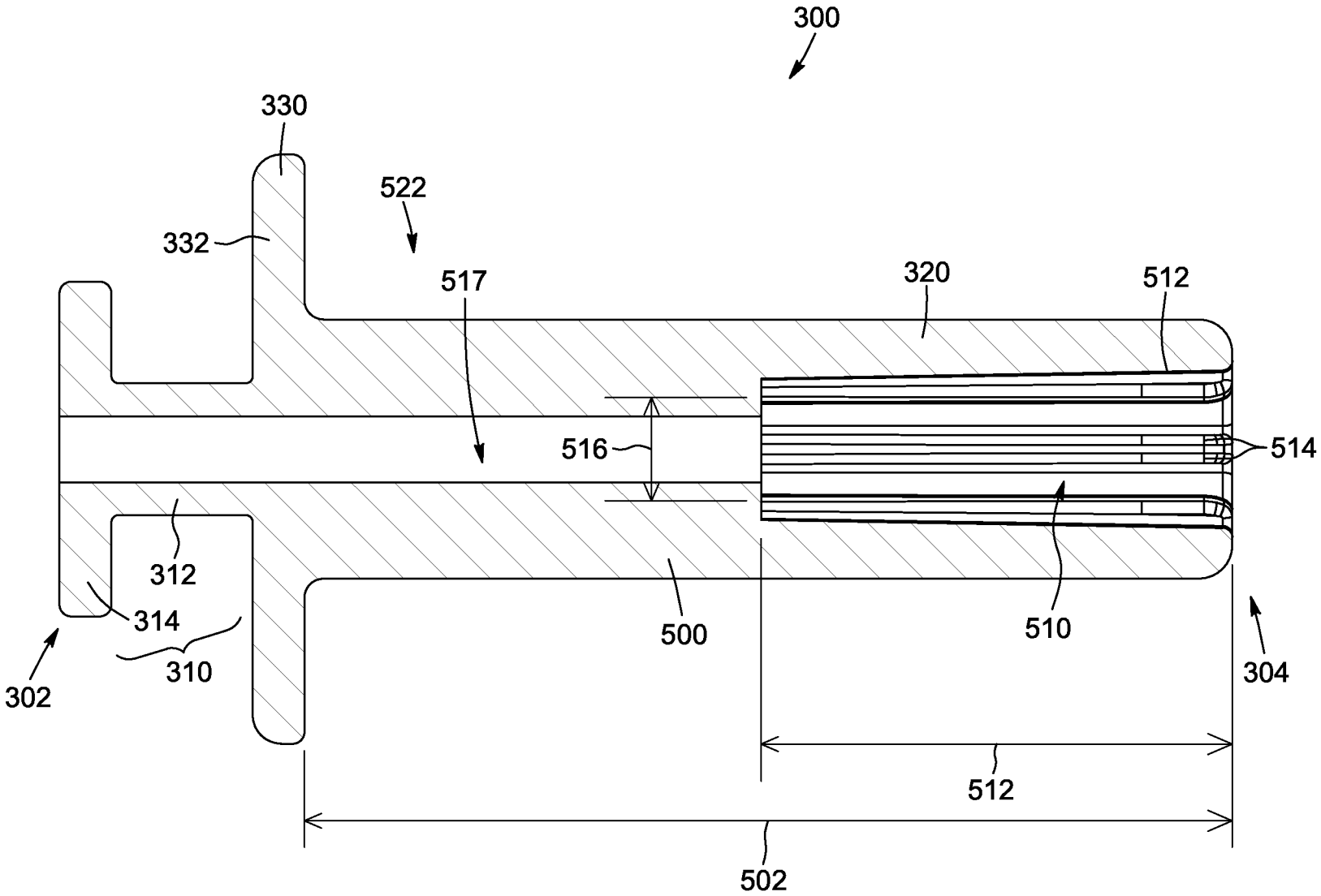
FIG. 7 is a cross-section view of the second spindle element of the spindle assembly of FIGS. 1 and 2.

As shown in FIG. 7, in the first embodiment of the spindle assembly 100, the assembling sleeve 500 has an inner surface 512 and at least one fitting rib 514 radially extending from the inner surface. The fitting rib 514 is configured to further secure the first and second spindle elements 200, 300 together, when the assembling rod 400 is received in the assembling cavity 510 (i.e. when the first and second spindle elements 200, 300 are configured in an assembled configuration).

The plurality of fitting ribs 514 protruding inwardly—considered with respect to the assembling cavity 510—from the inner surface 512 of the assembling sleeve 500 are shaped and dimensioned to form axial couplers of the assembling sleeve 500 and the assembling rod 400. In other words, the plurality of fitting ribs 514 protruding inwardly from the inner surface 512 of the assembling sleeve 500 are shaped and dimensioned to axially couple together the assembling rod 400 and the assembling sleeve 500 upon translation along a direction substantially parallel to a longitudinal axis of the spindle assembly 100 (for instance upon translation along a direction substantially parallel to the central axis X1 of the web material roll 20) of one of the bushing-engaging member 200 and the spindle connection member 300 when configured in the assembled configuration.

Moreover, the plurality of ribs 514 protruding inwardly—considered with respect to the assembling cavity 510—from the inner surface 512 of the assembling sleeve 500 are shaped and dimensioned to form angular couplers between the assembling sleeve 500 and the assembling rod 400. In other words, the plurality of ribs 514 protruding inwardly from the inner surface 512 of the assembling sleeve 500 are shaped and dimensioned to angularly couple together the assembling rod 400 and the assembling sleeve 500 upon rotation about of the longitudinal axis of the spindle assembly 100 (for instance upon rotation about the central axis X1 of the web material roll 20) of one of the bushing-engaging member 200 and the spindle connection member 300 when configured in the assembled configuration.

Other axial and/or angular couplers of the assembling rod 400 and the assembling sleeve 500 could be conceived.

For instance, in the second embodiment of the spindle assembly 700, as represented for instance in FIG. 14, a connection recess 1003 is formed in an outer surface 1005 of the assembling rod 1000. The connection recess 1003 is configured to cooperate with a coupling protrusion 921 protruding from an inner surface 1112 of the assembling sleeve 1100 of the second spindle element 900. In other words, the connection recess 1003 and the coupling protrusion 921 are engageable together to connect the first and second spindle elements 800, 900 when configured in the assembled configuration.

In the embodiment shown, the connection recess 1003 comprises an annular groove formed in the outer surface 1005 of the assembling rod 1000, at the free end 1002 thereof. For instance, the connection recess 1003 extends substantially along an entirety of an outer periphery of the free end 1002 of the assembling rod 1000.

In the embodiment shown, the coupling protrusion 921 is substantially bendable (for instance by being made in a material being substantially resilient and/or flexible) to be engaged in the coupling recess 1003 upon insertion or engagement of the assembling rod 1000 in the assembling cavity 1110 defined by the assembling sleeve 1100. Moreover, the bending of the coupling protrusion 921 further allows the disengagement of the assembling rod 1000 from the assembling cavity 1110 upon translation of the first and second spindle elements 800, 900 along opposed directions. The coupling protrusion 921 and the coupling recess 1003 thus form together another possible embodiment of the axial coupler of the spindle assembly 700.

In the embodiment shown, the coupling protrusion 921 and the coupling recess 1003 are configured to generate, upon engagement of the coupling protrusion 921 in the coupling recess 1003, an audible indication of a proper configuration of the bushing-engaging member 800 and the spindle connection member 900 in the assembled configuration. For instance, the audible indication is a clicking sound.

It could also be conceived a coupling recess that would only extend along a portion of the outer periphery of the outer surface of the assembling rod so that the coupling recess and the coupling protrusion would also form an angular coupler of the spindle assembly.

It is appreciated that the shape, the configuration, and the location of the axial and angular couples can vary from the embodiments shown.

Referring back to FIGS. 1 to 12 of the first embodiment of the spindle assembly 100, the assembling sleeve 500 has a length 502 and the assembling cavity 510 extends partially along the length 502 of the assembling sleeve 500. In other words, the assembling cavity 510 has a length 512 smaller than the length 502 of the assembling sleeve 500. Optionally, the length 512 of the assembling cavity 510 is more than about 30% of the length 502 of the assembling sleeve 500, optionally more than about 40%, optionally more than about 50%.

The assembling cavity 510 has a cross-section 516—considered between facing ribs 514 protruding inwardly from the inner surface 512—corresponding substantially to the cross-section 403 of the free end 402 of the assembling rod 400, for the assembling rod 402 to be fitted in and connected to the assembling cavity 510 (i.e. for the assembling rod 400 and the assembling sleeve 500 to be in frictional engagement together).

The assembling sleeve 500 further comprises a proximal portion 522 located between the portion of the assembling sleeve 500 in which the assembling cavity 510 is formed, and the second dispenser mounting portion 310. Recesses and/or a central opening 517 might be formed in the proximal portion 522, for instance to reduce a weight of the second spindle element 300 and/or to ease the manufacturing of the second spindle element 300.

As shown, the assembling sleeve 500 has a cross-section 520 substantially constant along the length 502 of the assembling sleeve 500. Optionally, the cross-section 520 is smaller than the cross-section 27 of the central cavity 26, so that the assembling sleeve 500 does not support the central core 23 of the web material roll 20 when inserted in the central cavity 26. However, an assembling sleeve 500 dimensioned and configured to at least partially support the central core 23 of the web material roll 20 (so that the second spindle element 300 supports at least partially the web material roll 20) could be conceived.

It is appreciated that the shape and the configuration of the assembling sleeve 500 can vary from the embodiment shown.

Second Abutting Portion

The second spindle element 300 further comprises a second abutting portion 330 (or second handling portion or second insertion-limiting portion or second engagement-limiting portion) located between the assembling sleeve 500 and the second dispenser mounting portion 310. In other words, the second abutting portion 330 and the second blocking disk 314 form two axially spaced enlargements at the second dispenser mounting portion 310. It is appreciated that the shape and the number of the axially spaced enlargements can vary from the embodiment shown.

Optionally, the second abutting portion 330 comprises an abutting disk 332 having a cross-section 334 greater than a cross-section of the second blocking disk 314. The cross-section 334 of the second abutting disk 332 is also greater than the cross-section 27 of the central cavity 26, so that the second abutting portion 330 abuts against the lateral side 28 of the roll 20 when the second spindle element 300 is engaged into the central cavity 26 of the web material roll 20 via the second extremity 24. The second abutting portion 330 thus limits the engagement of the second spindle element 300 into the central cavity 26 of the roll 20. It could also be conceived a second spindle element 300 that would be shaped and dimensioned for the second abutting portion 330 not to contact the roll 20.

Construction

Optionally, the second spindle element 300 is made of a single partially hollow piece, but a second spindle element made of a plurality of distinct pieces assembled together, could be conceived. For instance, the second spindle element 900 of the second embodiment of the spindle assembly 700 is made of two pieces (i.e. the second spacing element 911 and the remaining of the second spindle element 900).

Roll Dispensing Assembly

According to another aspect of the disclosure, there is provided a roll dispensing assembly 600, 1200 comprising a roll 20 of web material 21 having first and second extremities 22, 24 and defining a central cavity 26 provided with a bushing 30, toward the first extremity 22. The roll dispensing assembly 600, 1200 further comprises a spindle assembly 100, 700 according to the present disclosure, having first and second spindle elements 200, 300, 800, 900 mountable respectively to the first and second extremities 22, 24 of the roll 20 of web material.

Method

According to another aspect of the disclosure, there is provided a method for inserting a roll 20 of web material 21 in a dispenser 10, the dispenser 10 having first and second sides 12, 16, and the roll 20 of web material 21 having first and second extremities 22, 24 and defining a central cavity 26 provided with a bushing 30, toward the first extremity 22.

The method according to embodiments of the present disclosure may be carried out with a spindle assembly 100, 700 as described above.

The method firstly comprises providing a spindle assembly 100, 700 such as the ones described above, comprising first and second spindle elements 200, 300, 800, 900. The method then comprises, as represented in FIGS. 8 to 10, engaging the first spindle element 200 in the bushing 30 of the roll 20 of web material 21.

The free end 402 of the assembling rod 400 is firstly introduced in the central cavity 26 of the roll 20 via the first extremity 22. In the embodiment shown, the free end 402 of the assembling rod 400 is engaged in the bushing 30, until the first abutting portion 280 abuts against the lateral side 25 of the web material roll 20 and against the outside collar 38 of the bushing 30, in the embodiment in which the bushing 30 comprises an outside collar 38.

While inserting the first spindle element 200 in the bushing 30, the tapered head 270 is introduced in the opening 42 of the wall 40 and deforms/pivots the wall 40 of the bushing 30. When the first spindle element 200 is fully engaged in the central cavity 26, as shown in FIGS. 8 to 10, the free end 402 of the assembling rod 400 extends beyond the wall 40 of the bushing 30, so that the wall 40 extends between the free end 402 and the proximal portion 230 of the bushing mounting portion 220. In this configuration, the first and second bearing surfaces 44, 46 of the bushing 30, as shown in FIGS. 9 and 10, cooperate respectively with the outer surface of the proximal portion 230 and with the outer surface of the distal portion 250. It is thus understood that the first diameter d1 of the first bearing surface 44 and the second diameter d2 of the second bearing surface 46 substantially correspond respectively to the cross-section 232 of the proximal portion 230 and to the cross-section 252 of the distal portion 250. As shown, the second bearing surface 46 is kept at an adequate position of the distal portion 250 via the blocking protrusion 276.

The method then comprises introducing the second spindle element 300 in the central cavity 26 of the roll 20 via the second extremity 24. Optionally, the second end 304 (or inner end) of the second spindle element 300 is introduced in the central cavity 26 until the free end 402 of the assembling rod 400 reaches a proximal portion of the assembling cavity 510, i.e. until the free end 402 abuts against the proximal portion 522 of the assembling sleeve 500 to configure the first and second spindle elements 200, 300 in the assembled configuration. In the embodiment shown in FIG. 19, the method further comprises engaging the coupling protrusion 921 in the connection recess 1003 and/or comprises generating an audible indication (for instance a clicking sound) when the first and second spindle elements 800, 900 are properly configured in the assembled configuration.

In the embodiment shown, the second end 304 of the second spindle element 300 is introduced in the central cavity 26 until the second abutting portion 330 abuts against the lateral side 28 of the roll of web material 20. The spindle assembly 100 could also be used mounted onto smaller rolls of web material, in which case the second abutting portion 330 might not abut against the lateral side 28 of the web material roll 20.

Figure 22:
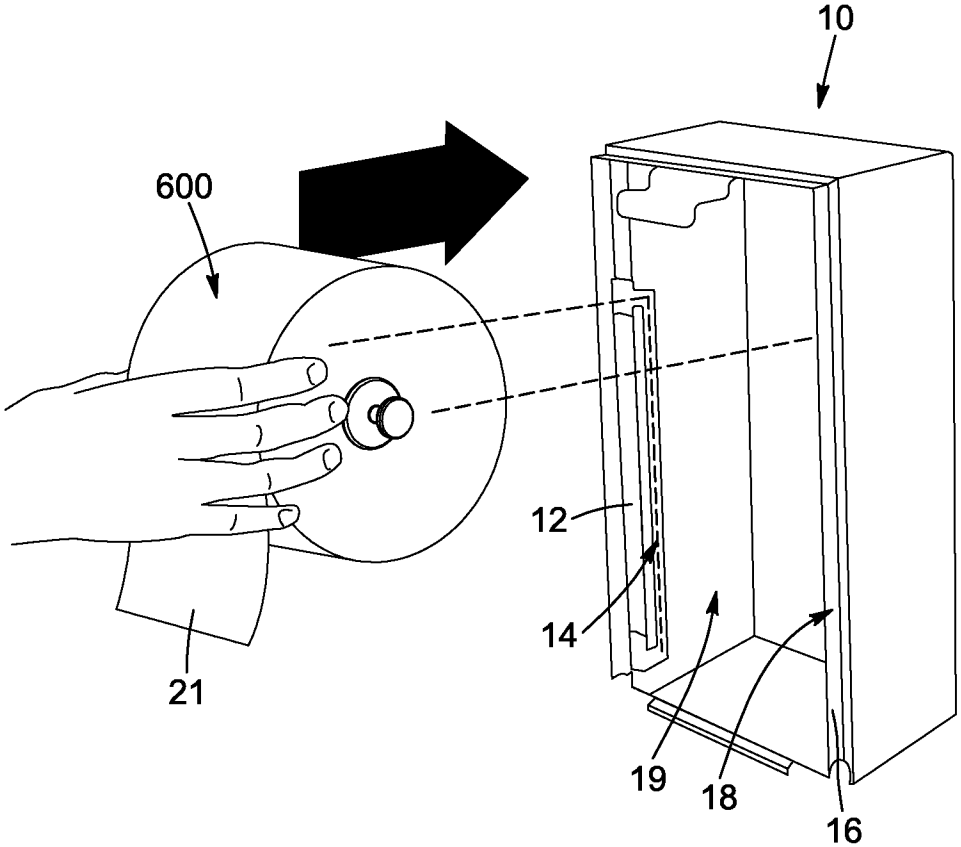
FIG. 22 is a front perspective view of the web material dispenser of FIG. 21 with the conventional mandrel removed, so as to allow use of a roll dispensing assembly in accordance with an embodiment.

The method further comprises mounting (for instance removably) the first and second dispenser mounting portions 210, 310 respectively to the first and second sides 12, 16 of the dispenser 10, as represented in FIG. 22. In the embodiment shown, the mounting of the first and second dispenser mounting portions 210, 310 comprises sliding the first and second dispenser mounting portions 210, 310 in the first and second guiding rails 14, 18 formed in the first and second sides 12, 16 of the web material dispenser 10.

The web material 21 can thus be delivered to a user by grapping the free end of the web material 21 and rotating the roll 20 of web material in the dispenser 10. Depending, for instance, on the pulling force exerted by the user, the first and second spindle elements 200, 300 might be rotated respectively in the first and second guiding rails 14, 16, or remain fixed. Moreover, as mentioned above, depending also, for instance on the pulling force exerted by the user, the bushing-engaging member 200 might be rotated in the bushing 30 or remain fixed with respect to the web material 20 provided with the bushing 30.

Figure 23:
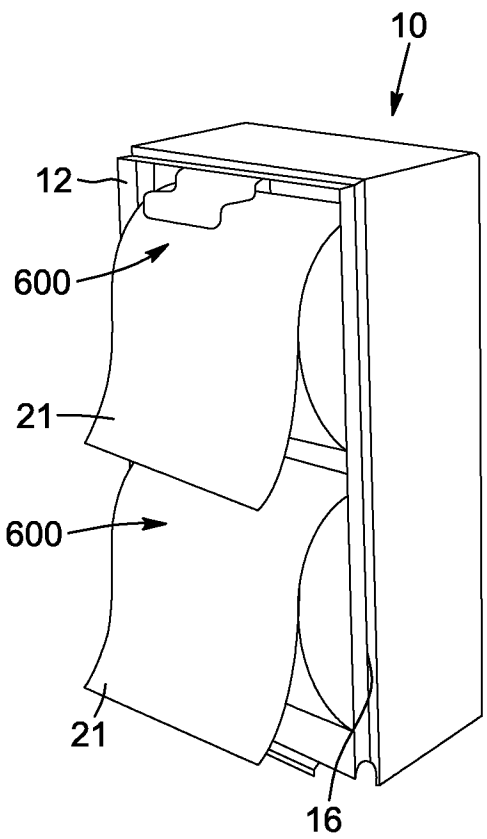
FIG. 23 is a front perspective view of the web material dispenser of FIG. 22, with two roll dispensing assemblies being inserted therein, the web material rolls being provided with bushings, such as shown in FIG. 20.

In the embodiment shown, as represented in FIG. 23, the web material dispenser 10 is shaped and dimensioned to receive two roll dispensing assemblies 600 in a vertically-superposed configuration. Other web material dispensers could be conceived that would be configured to receive one or more roll dispensing assemblies 600, 1200 in accordance with the present disclosure.

The spindle assembly 100, 700 in accordance with the present disclosure can be used to support different types of web material rolls, such as web material rolls having a central cavity with a bushing inserted therein, in different types of dispensers. The cooperation between the first and second spindle elements 200, 300, 800, 900 can be adjusted depending on the dimensions of the web material rolls and the dispensers. For instance, the distance between the first and second dispenser mounting portions 210, 310, 810, 910 can be adjusted by configuring the assembling rod 400, 1000 in one of the first and second configurations (or retracted and extended configurations) or by inserting either a portion or an entirety of the free end 402, 1002 of the assembling rod 400, 1000 in the assembling cavity 510, 1110 defined by the assembling sleeve 500, 1100.

The steps of the method can be carried out in a reverse order to remove and replace the roll 20 of web material, for instance when the entirety of the web material 21 has been dispensed. The method firstly comprises removing the first and second dispenser mounting portions 210, 310, 810, 910 from the first and second sides 12, 16 of the dispenser 10. The method then comprises disassembling the first and second spindle elements 200, 300, 800, 900 and removing the second spindle element 300, 900 from the central cavity 26 of the web material roll 20. The method then comprises removing the first spindle element 200, 800 from the bushing 30. Optionally, the removal of the first spindle element 200, 800 can at least partially break the wall 40 of the bushing 30: the wall 40 can indeed be at least partially received in one of the recess 274, 874, 875 of the first spindle element 200, 800 and abut against the substantially vertical rear face of the tapered head 270, 870.

Figure 21:
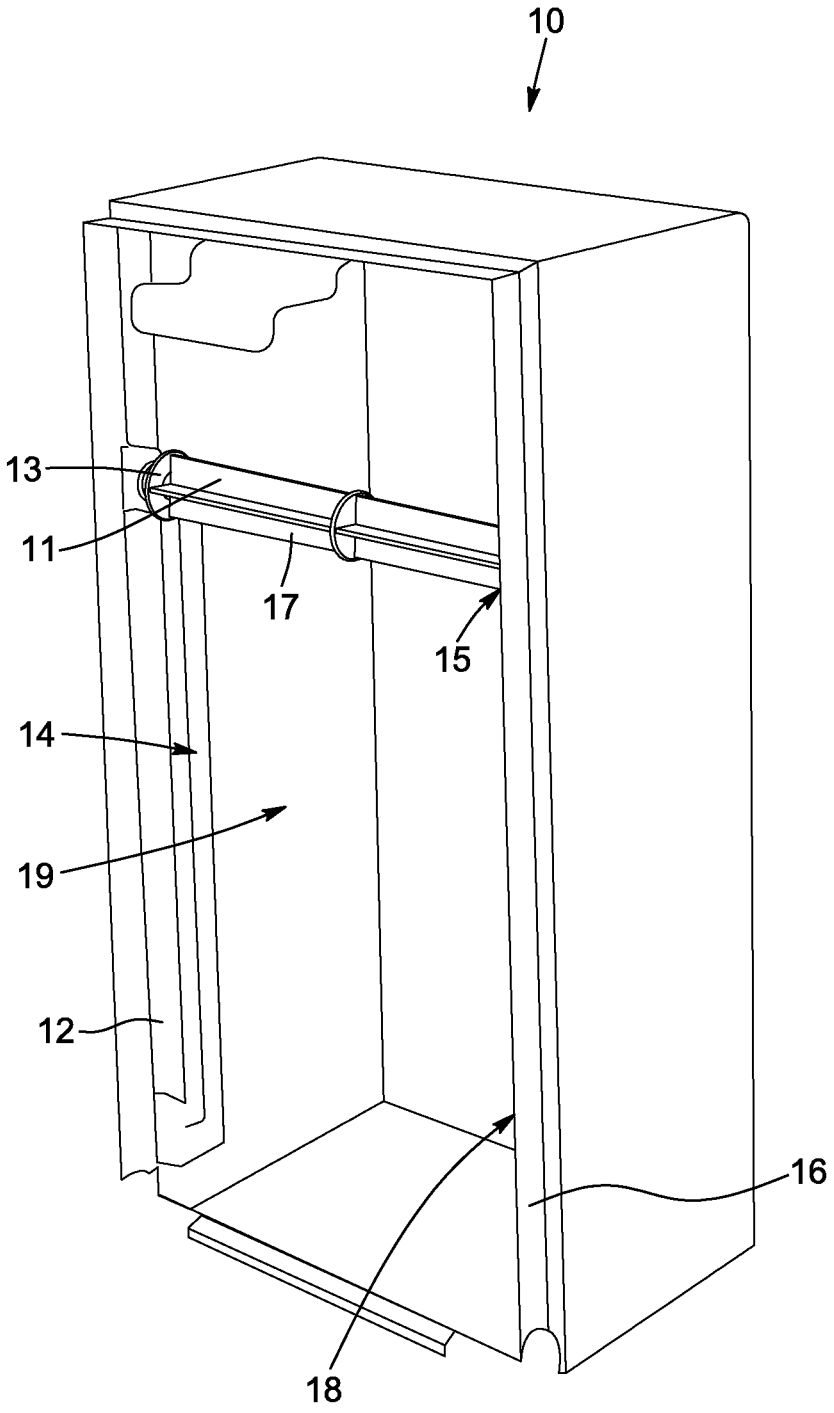
FIG. 21 is a front perspective view of the web material dispenser of FIG. 12, with a conventional mandrel mounted to the first and second sides of the web material dispenser.

The spindle assembly 100, 700 according to the present disclosure (or spindle adaptor) thus allows replacing a conventional spindle (or mandrel) of dispensers with the "spindle assembly" or "spindle adaptor", so as to allow receiving rolls provided with a bushing inserted therein. FIG. 21 represents a possible embodiment of a conventional spindle 11 (or mandrel, or web material roll support) that would prevent a web material roll 20 having a central cavity 26 provided with a bushing 30 from being dispensed by the dispenser 10. In the embodiment shown, the mandrel 11 comprises first and second dispenser mounting portions 13, 15 mountable respectively to the first and second sides 14, 16 of the dispenser 10. The mandrel 11 further comprises a body 17 extending between the first and second dispenser mounting portions 13, 15 and having a substantially constant cross-section that prevents the mandrel 11 from being engaged in the bushing 30 provided in the cavity 26 of the web material roll 20.

The spindle assembly 100, 700 thus allows dispensing different types of rolls of web material with a bushing inserted in the cavity of the roll in different types of dispensers. In other words, thanks to the spindle assembly 100, 700, the type of rolled material web dispensable by the dispenser 10 is not limited solely to the rolls configured to cooperate with the conventional spindle of the dispenser 10.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited by the scope of the appended claims.

For instance, the assembling rod 400, 1000 could extend from the inner end 304, 904 (opposed to the outer end 302, 902) of the second spindle element 300, 900 and the assembling sleeve 500, 1100 could be formed in the first spindle element 200, 800.

In another embodiment (not represented), the bushing-engaging member of the spindle assembly could be dimensioned to extend from the first extremity of the web material roll to the second extremity and would comprise first and second dispenser mounting portions to be mounted to the first and second sides 12, 16 of the web material dispenser 10. In other words, the bushing-engaging member could comprise a bushing-mounting portion extending between the first and second dispenser mounting portions. For instance, the second dispenser mounting portion of the bushing-engaging member would have an outer cross-section smaller than an inner cross-section of the bushing, for the second dispenser mounting portion to be introduced into the central cavity of the web material roll via the first extremity.

It could also be conceived a web material roll that would be shaped and dimensioned to be dispensed in a web material dispenser with a spindle assembly comprising only a bushing-engaging member with a first dispenser mounting portion. In other words, it could be conceived a web material roll that would be shaped and dimensioned to be mounted to the web material dispenser only by the first dispenser mounting portion of the bushing-engaging member. For instance, the bushing-engaging portion of the bushing-engaging member could be shaped and dimensioned to fully support the web material roll.

As can be appreciated, the spindle assembly described above advantageously allows insertion of paper rolls provided with bushings in conventional dispensers. Of course, numerous modifications could be made to the embodiments described above without departing from the scope of the present disclosure.

The invention claimed is:

1. A spindle assembly for supporting a web material roll in a web material dispenser having first and second opposed sides, the web material roll having first and second extremities and defining a central cavity provided with a bushing snugly fitted therein toward the first extremity, the bushing having an inner bearing surface, the spindle assembly comprising:

a bushing-engaging member comprising:

a first dispenser-mounting portion mountable to the first side of the web material dispenser, and a bushing-engaging portion sized and configured to fit at least partially in the bushing and comprising a cylindrical portion having an outer surface facing and being rotatable with respect to the inner bearing surface when at least partially fitted in the bushing; and a spindle connection member comprising:

a second dispenser-mounting portion mountable to the second side of the web material dispenser, and a connecting portion mountable to at least one of the second extremity of the web material roll and the bushing-engaging member;

thereby allowing use of the web material roll with the bushing in the web material dispenser.

2. The spindle assembly according to claim 1, wherein the bushing-engaging portion comprises:

a proximal portion proximate to the first dispenser-mounting portion, and a free end, at least one of the proximal portion and the free end comprising said cylindrical portion, the bushing-engaging portion having a cross-section decreasing from the proximal portion towards the free end.

3. The spindle assembly according to claim 2, wherein the bushing-engaging portion further comprises a distal portion located between the proximal portion and the free end, the distal portion having a smaller cross section than a cross section of the proximal portion, and wherein a tapered head bulges at the free end.

4. The spindle assembly according to claim 1, wherein a peripheral recess is formed in the bushing-engaging portion, the peripheral recess extending around substantially an entirety of an outer periphery of the bushing-engaging portion.

5. The spindle assembly according to claim 1, wherein the bushing-engaging portion has an outer surface and further comprises a blocking protrusion extending from the outer surface of the bushing-engaging portion.

6. The spindle assembly according to claim 1, wherein the connecting portion is removably mountable to the bushing-engaging portion and wherein:

one of the bushing-engaging member and the spindle connection member comprises an assembling rod; and wherein the other one of the bushing-engaging member and the spindle connection member comprises an assembling sleeve defining an assembling cavity to receive at least partially the assembling rod for the bushing-engaging member and the spindle connection member to be configured in an assembled configuration.

7. The spindle assembly according to claim 6, wherein the spindle assembly defines a longitudinal axis and further comprises an angular coupler angularly coupling together the assembling rod and the assembling sleeve upon rotation about of the longitudinal axis of one of the bushing-engaging member and the spindle connection member when configured in the assembled configuration.

8. The spindle assembly according to claim 7, further comprising an axial coupler axially coupling together the assembling rod and the assembling sleeve upon translation along a direction substantially parallel to the longitudinal axis of one of the bushing-engaging member and the spindle connection member when configured in the assembled configuration.

9. The spindle assembly according to claim 6, wherein insertion of the assembling rod within the assembling cavity generates an audible indication of a proper configuration of the bushing-engaging member and the spindle connection member in the assembled configuration.

10. The spindle assembly according to claim 6, wherein the assembling rod comprises a free end and is configurable in at least a first configuration and a second configuration in which the free end of the assembling rod is respectively at first and second different distances from the first dispenser-mounting portion.

11. The spindle assembly according to claim 1, wherein at least one of the first and second dispenser-mounting portions is rotatably mountable to the corresponding one of the first and second sides of the web material dispenser.

12. The spindle assembly according to claim 11, wherein a first guiding rail is formed in the first side of the web material dispenser, the first dispenser-mounting portion comprising a first shaft removably receivable in the first guiding rail.

13. The spindle assembly according to claim 12, wherein the first dispenser-mounting portion further comprises a first blocking disk, the first shaft extending between the first blocking disk and the bushing-engaging portion.

14. The spindle assembly according to claim 13, wherein the bushing-engaging member further comprises a first abutting portion located between the bushing-engaging portion and the first blocking disk.

15. The spindle assembly according to claim 12, wherein a second guiding rail is formed in the second side of the web material dispenser, the second dispenser-mounting portion comprising a second shaft removably receivable in the second guiding rail, and wherein the second dispenser mounting portion comprises a second blocking disk, the second shaft extending between the second blocking disk and the connecting portion.

16. The spindle assembly according to claim 15, wherein the spindle connection member further comprises a second abutting portion located between the connecting portion and the second blocking disk.

17. A roll dispensing assembly comprising:

a web material roll having first and second extremities and defining a central cavity provided with a bushing toward the first extremity; and the spindle assembly according to claim 1, the bushing-engaging member and the spindle connection member being mountable respectively to the first and second extremities of the web material roll.

18. The roll dispensing assembly according to claim 17, wherein the bushing-engaging portion has a proximal portion and a distal portion, the inner bearing surface being a first bearing surface, wherein the bushing has a second bearing surface, the first and second bearing surfaces being for rotation against respectively the proximal portion and the distal portion of the bushing-engaging portion.

19. The roll dispensing assembly according to claim 18, wherein the bushing-engaging portion further comprises a free end and a tapered head bulging at the free end, a shoulder being formed between the distal portion and the tapered head, wherein the bushing comprises a wall extending in the central cavity of the web material roll, and wherein the shoulder abuts against the wall when the bushing-engaging member is forced out of the bushing.

20. The roll dispensing assembly according to claim 19, wherein a recess is formed in the bushing-engaging portion behind the tapered head, and wherein the wall is at least partially received in the recess when the bushing-engaging member is forced out of the bushing.

21. The roll dispensing assembly according to claim 20, wherein the bushing-engaging portion has an outer surface and comprises a blocking protrusion extending from the outer surface of the bushing-engaging portion, wherein the wall of the bushing abuts against the blocking protrusion of the bushing-engaging portion when the bushing-engaging member is mounted to the first extremity of the web material roll.

22. A spindle assembly for supporting a web material roll in a web material dispenser having first and second opposed sides, the web material roll having first and second extremities and defining a central cavity provided with a bushing snugly fitted therein toward the first extremity, the bushing having an inner bearing surface, the spindle assembly defining a longitudinal axis and comprising:

a bushing-engaging member comprising:

a first dispenser-mounting portion mountable to the first side of the web material dispenser, and a bushing-engaging portion extending from the first dispenser mounting portion and being at least partially engageable in the bushing of the web material roll, the bushing-engaging portion having an outer bushing-contacting surface extending along at least a portion of a length of the bushing-engaging portion and substantially along an entirety of an outer periphery of the bushing-engaging portion, the outer bushing-contacting surface facing and being rotatable with respect to the inner bearing surface when at least partially fitted in the bushing; and a spindle connection member comprising:

a second dispenser-mounting portion removably to the second side of the web material dispenser; and a connecting portion at least partially engageable into the cavity of the web material roll toward the second extremity and connectable to the bushing-engaging portion to configure the spindle connection member and the bushing-engaging member in an assembled configuration thereby allowing use of the web material roll with the bushing in the web material dispenser.

23. The spindle assembly according to claim 22, wherein the bushing-engaging portion comprises a proximal portion proximate to the first dispenser-mounting portion and having the outer bushing-contacting surface, the bushing-engaging portion comprising a free end and a distal portion located between the proximal portion and the free end, the distal portion having a smaller cross section than a cross section of the proximal portion, a head bulging at the free end and a peripheral recess being formed in the bushing-engaging portion.

24. The spindle assembly according to claim 22, wherein:

one of the bushing-engaging member and the spindle connection member comprises an assembling rod; and wherein the other one of the bushing-engaging member and the spindle connection member comprises an assembling sleeve defining an assembling cavity to receive at least partially the assembling rod when the bushing-engaging member and the spindle connection member are configured in the assembled configuration; wherein the spindle assembly further comprises an angular coupler angularly coupling together the assembling rod and the assembling sleeve upon rotation about the longitudinal axis of one of the bushing-engaging member and the spindle connection member when configured in the assembled configuration; and wherein the spindle assembly further comprises an axial coupler axially coupling together the assembling rod and the assembling sleeve upon translation along a direction substantially parallel to the longitudinal axis of one of the bushing-engaging member and the spindle connection member when configured in the assembled configuration.

25. The spindle assembly according to claim 22, wherein at least one of the first and second dispenser-mounting portions is removably and rotatably mountable to the corresponding one of the first and second sides of the web material dispenser.

26. The spindle assembly according to claim 25, wherein:

a first guiding rail is formed in the first side of the web material dispenser, the first dispenser-mounting portion comprising a first shaft receivable in the first guiding rail, wherein the first dispenser mounting portion comprises a first blocking disk, the first shaft extending between the first blocking disk and the bushing-engaging portion; and wherein a second guiding rail is formed in the second side of the web material dispenser, the second dispenser-mounting portion comprising a second shaft receivable in the second guiding rail and wherein the second dispenser mounting portion comprises a second blocking disk, the second shaft extending between the second blocking disk and the connecting portion, the spindle connection member further comprising a second abutting portion located between the connecting portion and the second blocking disk.

27. A method for inserting a web material roll in a web material dispenser, the web material dispenser having first and second sides, the web material roll having first and second extremities and defining a central cavity provided with a bushing snugly fitted therein toward the first extremity, the bushing having an inner bearing surface, the method comprising:

providing a spindle assembly comprising:

a bushing-engaging member comprising a first dispenser mounting portion and a bushing-engaging portion comprising a cylindrical portion having an outer surface; and a spindle connection member comprising a second dispenser mounting portion and a connecting portion;

engaging the bushing-engaging portion in the bushing of the web material roll for the outer surface of the cylindrical portion to face and be rotatable with respect to the inner bearing surface; and introducing the spindle connection member in the central cavity via the second extremity.

28. The method according to claim 27, further comprising:

mounting the connecting portion to the bushing-engaging portion to configure the bushing-engaging member and the spindle connection member in an assembled configuration.

29. The method according to claim 28, wherein the bushing-engaging portion comprises an assembling sleeve defining an assembling cavity and wherein the spindle connection member comprises an assembling rod, the method further comprising:

at least partially engaging the assembling rod in the assembling cavity.

* * * * *